US007517838B2

(12) United States Patent
Kawahara et al.

(10) Patent No.: US 7,517,838 B2
(45) Date of Patent: Apr. 14, 2009

(54) LUBRICATING OIL FOR BEARING

(75) Inventors: Yasuyuki Kawahara, Uji (JP); Kouji Takahashi, Kyoto (JP); Hirotaka Tomizawa, Tokorozawa (JP)

(73) Assignee: New Japan Chemical Co., Ltd., Kyoto-shi (JP)

( * ) Notice: Subject to any disclaimer, the term of this patent is extended or adjusted under 35 U.S.C. 154(b) by 257 days.

(21) Appl. No.: 10/524,843

(22) PCT Filed: Aug. 22, 2003

(86) PCT No.: PCT/JP03/10608

§ 371 (c)(1),
(2), (4) Date: Feb. 17, 2005

(87) PCT Pub. No.: WO2004/018595

PCT Pub. Date: Mar. 4, 2004

(65) Prior Publication Data

US 2006/0019840 A1 Jan. 26, 2006

(30) Foreign Application Priority Data

Aug. 22, 2002 (JP) ..... 2002-241277

(51) Int. Cl.
*C10M 105/38* (2006.01)
*C10M 169/04* (2006.01)

(52) U.S. Cl. ..... 508/485; 508/280

(58) Field of Classification Search ..... 508/280, 508/465, 485

See application file for complete search history.

(56) References Cited

U.S. PATENT DOCUMENTS

| | | | | |
|---|---|---|---|---|
| 2,281,676 | A * | 5/1942 | Cook | 508/459 |
| 3,360,547 | A * | 12/1967 | Wilson et al. | 560/193 |
| 3,790,478 | A * | 2/1974 | Rudston et al. | 508/298 |
| 5,652,201 | A * | 7/1997 | Papay et al. | 508/228 |

FOREIGN PATENT DOCUMENTS

| | | |
|---|---|---|
| GB | 1293225 | 10/1972 |
| GB | 1293225 A | 10/1972 |
| JP | 07-053984 | 2/1995 |
| JP | 09-125086 | 5/1997 |
| JP | 11-172267 | 6/1999 |
| JP | 2000-336384 | 12/2000 |
| JP | 2002-336384 | 12/2000 |
| JP | 2001-279284 | 10/2001 |
| JP | 2002-097482 | 4/2002 |
| JP | 2002-146374 | 5/2002 |
| JP | 2002-195252 | 7/2002 |
| JP | 2003-119482 | 4/2003 |
| JP | 2003-321691 | 11/2003 |

OTHER PUBLICATIONS

International Search Report dated Dec. 9, 2003.

* cited by examiner

*Primary Examiner*—Glenn Caldarola
*Assistant Examiner*—Jim Goloboy
(74) *Attorney, Agent, or Firm*—Kratz, Quintos & Hanson, LLP

(57) ABSTRACT

Disclosed herein is a lubricating oil for bearings comprising (a) a diester represented by General Formula (1)

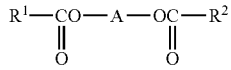

(1)

wherein $R^1$ and $R^2$ are the same or different, and each represents a $C_3$-$C_{17}$ linear alkyl group; A represents a $C_2$-$C_{10}$ linear alkylene group or A represents a branched alkylene group consisting of a linear alkylene group, the linear alkylene group being the principal chain, and one or more alkyl groups (branches) bonded to the linear alkylene group, wherein the total number of carbon atoms of the linear alkylene group and the one or more alkyl groups is 3 to 10; with the proviso that when A is a branched alkylene group and has two or more alkyl groups, the two or more alkyl groups are not bonded to the same carbon atom; or a mixture of the diester with an additional base oil and (b) at least one member selected from the group consisting of phenol-based antioxidants and amine-based antioxidants, and optionally containing (c) at least one member selected from the group consisting of Phosphorus-based compounds and aliphatic linear monocarboxylic acids, and further optionally containing (d) at least one member selected from the group consisting of benzotriazole-based compounds and gallic acid-based compounds.

22 Claims, No Drawings

LUBRICATING OIL FOR BEARING

TECHNICAL FIELD

The present invention relates to a lubricating oil for bearings, in particular, a lubricating oil for oil impregnated sintered bearings or fluid dynamic bearings.

BACKGROUND ART

Hitherto, oil impregnated sintered bearings have been used in motors for automotive use (electrical components), home appliances (air conditioners, refrigerators, etc.), audio equipments (CD players, MD players, etc.) and, in recent years, due to the rapid spread of computers (motors for memory devices) and mobile telephones (vibration motors), there has been an increasing demand for oil impregnated sintered bearings. The commercialization of fluid dynamic bearings is also being considered to reduce vibration over a wide rotational range. Furthermore, the increasingly large bearing loads resulting from the recent trend toward smaller and thinner equipments and higher motor speeds, have led to demands for improved bearing materials and bearing lubricating oils with higher performance.

It has been disclosed that lubricating oils containing a synthetic hydrocarbon oil such as a poly-α-olefin or an ester oil such as a dibasic acid diester or a neopentyl polyol ester exhibit excellent performance as lubricating oils for oil impregnated sintered bearings or fluid dynamic bearings (Japanese Unexamined Patent Publications Nos. 1995-53984, 1997-125086, and 1999-172267). However, these lubricating oils cannot satisfactorily withstand severe operating conditions, and therefore lubricating oils that exhibit further improved characteristics are demanded.

Specifically, characteristics required for such a bearing lubricating oil include excellent heat resistance (anti-oxidation stability, evaporation resistance, small change in viscosity), applicability over a wide temperature range, excellent lubricating ability, absence of influence on the bearing materials themselves, etc. Among these, considerable importance is being placed on heat resistance due to large temperature elevation caused by increased loads on bearings.

Furthermore, reduced electrical power consumption is also demanded in order to reduce emission of carbon dioxide which causes global warming. Therefore, to reduce energy losses caused by viscous friction, lubricating oils for bearings are required to have a low viscosity over a wide temperature range and low friction. Generally, however, with a decrease in the viscosity of lubricating oils, heat resistance, and in particular evaporation resistance, tends to become poor, and therefore no lubricating oils with sufficient energy-saving capabilities for oil impregnated sintered bearings or fluid dynamic bearings have been realized.

DISCLOSURE OF THE INVENTION

A principal object of the present invention is to provide a lubricating oil for bearings that has low viscosity over a wide temperature range, and excellent heat resistance, lubricating ability, and low temperature fluidity.

To achieve the above object, the inventors conducted extensive research and found that a bearing lubricating oil comprising a specific aliphatic diester and a specific antioxidant has low viscosity over a wide temperature range, and is excellent in heat resistance, lubricating ability and low temperature fluidity. The inventors also found that said bearing lubricating oil, when further containing a specific compound, exhibits an improved lubricating ability and excellent metal compatibility, thereby having excellent properties as a lubricating oil for oil impregnated sintered bearings or fluid dynamic bearings. The present invention bas been accomplished based on these findings and further researches, and provides the following bearing lubricating oils.

Item 1. A lubricating oil for bearings comprising (a) a diester represented by General Formula (1)

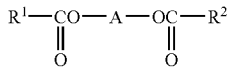

(1)

wherein $R^1$ and $R^2$ are the same or different, and each represents a $C_3$-$C_{17}$ linear alkyl group, and A represents a $C_2$-$C_{10}$ linear aliphatic dihydric alcohol residue or a branched aliphatic dihydric alcohol residue having one or more branches, (In other words, A represents a linear alkylene group having 2 to 10 carbon atoms, or a branched alkylene group consisting of a linear alkylene group, the linear alkylene group being the principal chain, and one or more alkyl groups (branches) bonded to the linear alkylene group, wherein the total number of carbon atoms of the linear alkylene group and the one or more alkyl groups is 2 to 10, with the proviso that, when A is a branched alkylene group and has two or more alkyl groups, the two or more alkyl groups are not bonded to the same carbon atom), or a mixture of the diester and an additional base oil, and (b) at least one member selected from the group consisting of phenol-based antioxidants and amine-based antioxidants.

Item 2. A lubricating oil for bearings according to Item 1, wherein A is a $C_3$-$C_{10}$ aliphatic dihydric alcohol residue having one or more branches (i.e., a mono- or polyalkyl-substituted linear alkylene group wherein the total number of carbon atoms of the alkyl group and the linear alkylene group is 3 to 10).

Item 3. A lubricating oil for bearings according to Item 1, wherein A is a $C_3$-$C_{10}$ aliphatic dihydric alcohol residue having one branch (i.e., a monoalkyl-substituted linear alkylene group wherein the total number of carbon atoms of the alkyl group and the linear alkylene group is 3 to 10).

Item 4. A lubricating oil for bearings according to Item 1, wherein A is a $C_{4-6}$ aliphatic dihydric alcohol residue having one branch (i.e., a monoalkyl substituted linear alkylene group wherein the total number of carbon atoms of the alkyl group and the linear alkylene group is 4 to 6).

Item 5. A lubricating oil for bearings according to Item 1, wherein A is a 3-methyl-1,5-pentanediol residue (i.e., a 3-methylpentylene group, $—CH_2CH_2—CH(CH_3)—CH_2CH_2—$).

Item 6. A lubricating oil for bearings according to any one of Items 1 to 5, wherein $R^1$ and $R^2$ are the same or different, and each represents a $C_3$-$C_{11}$ linear alkyl group.

Item 7. A lubricating oil for bearings according to Item 1, wherein the diester represented by General Formula (1) is a diester of a member selected from the group consisting of 2-methyl-1,3-propanediol, 1,3-butanediol, 2-methyl-1,4-butanediol, 1,4-pentanediol, 2-methyl-1,5-pentanediol, 3-methyl-1,5-pentanediol and 1,5-hexanediol, and a member selected from saturated aliphatic linear monocarboxylic acids having 7 to 10 carbon atoms.

Item 8. A lubricating oil for bearings according to Item 1, wherein the diester represented by General Formula (1) is a diester obtained from 3-methyl-1,5-pentanediol, and at least one member selected from the group consisting of n-heptanoic acid, n-octanoic acid, n-nonanoic acid and n-decanoic acid.

Item 9. A lubricating oil for bearings according to Item 1, wherein the diester represented by General Formula (1) is at least one member selected from the group consisting of 3-methyl-1,5-pentanediol di(n-octanoate) and 3-methyl-1,5-pentanediol di(n-nonanoate).

Item 10. A lubricating oil for bearings according to any one of Items 1 to 4, wherein the diester represented by General Formula (1) is a diester obtained from two kinds of fatty acids selected from saturated aliphatic linear monocarboxylic acids having 7 to 10 carbon atoms, and one kind of dihydric alcohol selected from the group consisting of 2-methyl-1,3-propanediol, 1,3-butanediol, 2-methyl-1,4-butanediol, 1,4-pentanediol, 2-methyl-1,5-pentanediol, 3-methyl-1,5-pentanediol and 1,5-hexanediol.

Item 11. A lubricating oil for bearings according to any one of Items 1 to 4, wherein the diester represented by General Formula (1) is a diester obtained from 3-methyl-1,5-pentanediol and two kinds of fatty acids selected from $C_7$-$C_{10}$ saturated aliphatic linear monocarboxylic acids.

Item 12. A lubricating oil for bearings according to any one of Items 1 to 4, wherein the diester represented by General Formula (1) is a diester obtained from 3-methyl-1,5-pentanediol and n-heptanoic acid and n-octanoic acid, a diester obtained from 3-methyl-1,5-pentanediol and n-heptanoic acid and n-nonanoic acid, a diester obtained from 3-methyl-1,5-pentanediol and n-heptanoic acid and n-decanoic acid, a diester obtained from 3-methyl-1,5-pentanediol and n-octanoic acid and n-nonanoic acid, a diester obtained from 3-methyl-1,5-pentanediol and n-octanoic acid and n-decanoic acid, or a diester obtained from 3-methyl-1,5-pentanediol and n-nonanoic acid and n-decanoic acid.

Item 13. A lubricating oil for bearings according to any one of Items 1 to 12, wherein the phenol-based antioxidant has 6 to 100 carbon atoms and contains no sulfur atoms in the molecule, and the amine-based antioxidant has 6 to 60 carbon atoms and containing no sulfur atoms in the molecule.

Item 14. A lubricating oil for bearings according to Item 13, wherein the phenol-based antioxidant is at least one member selected from the group consisting of 2,6-di-t-butylphenol, 2,6-di-t-butyl-p-cresol, 4,4'-methylenebis(2,6-di-t-butylphenol), 4,4'-butylidenebis(3-methyl-6-t-butylphenol), 2,2'-methylenebis(4-ethyl-6-t-butylphenol), 2,2'-methylenebis(4-methyl-6-t-butylphenol), 4,4'-isopropylidenebisphenol, 2,4-dimethyl-6-t-butylphenol, tetrakis[methylene-3-(3,5-di-t-butyl-4-hydroxyphenyl)propionate]methane, 1,1,3-tris(2-methyl-4-hydroxy-5-t-butylphenyl)butane, 1,3,5-trimethyl-2,4,6-tris(3,5-di-t-butyl-4-hydroxybenzyl)-benzene, 2,2'-dihydroxy-3,3'-di(α-methylcyclohexyl)-5,5'-dimethyl-diphenylmethane, 2,2'-isobutylidenebis(4,6-dimethylphenol), 2,6-bis(2'-hydroxy-3'-t-butyl-5'-methylbenzyl)-4-methylphenol, 1,1'-bis(4-hydroxyphenyl) cyclohexane, 2,5-di-t-amylhydroquinone, 2,5-di-t-butylhydroquinone, 1,4-dihydroxyanthraquinone, 3-t-butyl-4-hydroxyanisole, 2-t-butyl-4-hydroxyanisole, 2,4-dibenzoylresorcinol, 4-t-butylcatechol, 2,6-di-t-butyl-4-ethylphenol, 2-hydroxy-4-methoxybenzophenone, 2,4-dihydroxybenzophenone, 2,2'-dihydroxy-4-methoxybenzophenone, 2,4,5-trihydroxybenzophenone, α-tocopherol, bis[2-(2-hydroxy-5-methyl-3-t-butylbenzyl)-4-methyl-6-t-butylphenyl]terephthalate, triethylene glycol bis[3-(3-t-butyl-5-methyl-4-hydroxyphenyl)propionate], 1,6-hexanediol-bis[3-(3,5-di-t-butyl-4-hydroxyphenyl)propionate]; and the amine-based antioxidant is at least one member selected from the group consisting of diphenylamine, mono ($C_4$-$C_9$ alkyl)-substituted diphenylamines, p,p'-di(mono $C_4$-$C_9$ alkyl-phenyl)amines, and di(mono $C_4$-$C_9$alkyl-phenyl)amines wherein the alkyl group on one benzene ring is different from the alkyl group on the other benzene ring, di(di-$C_4$-$C_9$alkylphenyl)amines wherein at least one of the four alkyl groups on the two benzene rings is different from the other alkyl groups, N-phenyl-1-naphthylamine, N-phenyl-2-naphthylamine, 4-octylphenyl-1-naphthylamine, 4-octylphenyl-2-naphthylamine,p-phenylenediamine, N-phenyl-N'-isopropyl-p-phenylenediamine, and N-phenyl-N'-(1,3-dimethylbutyl)-p-phenylenediamine.

Item 15. A lubricating oil for bearings according to Item 13, wherein component (b) is a combination of at least one member selected from the group consisting of 2,6-di-t-butyl-p-cresol, 4,4'-methylene bis(2,6-di-t-butylphenol) and 2,6-di-t-butyl-4-ethylphenol with at least one member selected from the group consisting of p,p'-dioctyl (including linear and branched) diphenylamines, p,p'-dinonyl (including linear and branched) diphenylamines, and N-phenyl-1-naphthylamine.

In the present specification, "(including linear and branched)" means including either or both of linear alkyl and branched alkyl.

Item 16. A lubricating oil for bearings according to any one of Items 1 to 15, which further comprises (c) at least one member selected from the group consisting of phosphorus-based compounds and aliphatic linear monocarboxylic acids.

Item 17. A lubricating oil for bearings according to Item 16, wherein the phosphorus-based compound is at least one member selected from the group consisting of phosphoric acid triesters, phosphorous acid triesters, acid phosphates and acid phosphites, each having 12 to 70 carbon atoms and containing no sulfur atoms in the molecules, and the aliphatic linear monocarboxylic acid has 12 to 22 carbon atoms.

Item 18. A lubricating oil for bearings according to Item 16, wherein the phosphorus-based compound is at least one member selected from the group consisting of c1) tri(linear or branched $C_4$-$C_{18}$ alkyl) phosphates, c2) tri($C_4$-$C_8$ cycloalkyl) phosphates, c3) tri(unsubstituted or substituted phenyl) phosphates (the substituted phenyl group is substituted with 1 to 3 substituents selected from the group consisting of $C_1$-$C_{10}$ alkyl, halogen atom (in particular, bromine) and hydroxy group. One or two of the three phenyl groups may be unsubstituted and the rest may be substituted), c4) tri(linear or branched $C_4$-$C_{18}$ alkyl) phosphites, c5) tri($C_4$-$C_8$ cycloalkyl) phosphites, c6) tri(unsubstituted or substituted phenyl) phosphites (the substituted phenyl group is substituted with 1 to 3 substituents selected from the group consisting of $C_1$-$C_{10}$ alkyl, halogen atom (in particular, bromine) and hydroxy group. One or two of the three phenyl groups may be unsubstituted and the rest may be substituted), c7) di(linear or branched $C_4$-$C_{18}$ alkyl) phosphates, c8) di($C_4$-C8 cycloalkyl) phosphates, c9) di(unsubstituted or substituted phenyl) phosphates (the substituted phenyl group is substituted with 1 to 3 substituents selected from the group consisting of $C_1$-$C_{10}$ alkyl, halogen atom (in particular, bromine) and hydroxy group. One of the two phenyl groups may be unsubstituted and the rest may be substituted), c10) di(linear or branched $C_4$-$C_{18}$ alkyl) phosphites, c11) di($C_4$-$C_8$ cycloalkyl) phosphites, and c12) di(unsubstituted or substituted phenyl) phosphites (the substituted phenyl group is substituted with 1 to 3 substituents selected from the group consisting of $C_1$-$C_{10}$ alkyl, halogen atom (in particular, bromine) and hydroxy group. One of the two phenyl groups may be unsubstituted and the other may be substituted), and the aliphatic linear monocarboxylic acid has 14 to 18 carbon atoms.

Item 19. A lubricating oil for bearings according to Item 16, wherein said at least one member selected from the group consisting of a phosphorus-based compound and an aliphatic linear monocarboxylic acid is a combination of at least one member selected from the group consisting of tri(n-octyl) phosphate, triphenyl phosphate and tricresyl phosphate, with at least one member selected from the group consisting of n-tetradecanoic acid, n-hexadecanoic acid and n-octadecanoic acid.

Item 20. A lubricating oil for bearings according to any one of Items 16 to 19, which further comprises (d) at least one member selected from the group consisting of benzotriazole-based compounds and gallic acid-based compounds.

Item 21. A lubricating oil for bearings according to Item 20, wherein the benzotriazole-based compound has 6 to 60 carbon atoms and contains no sulfur atoms in the molecule, and the gallic acid-based compound has 7 to 30 carbon atoms.

Item 22. A lubricating oil for bearings according to Item 20, wherein the benzotriazole-based compound is at least one member selected from the group consisting of benzotriazole, 5-methyl-1H-benzotriazole, 1-dioctylaminomethylbenzotriazole, 1-dioctylaminomethyl-5-methylbenzotriazole, 2(5'-methyl-2'-hydroxyphenyl)benzotriazole, 2-[2'-hydroxy-3',5'-bis(α,α-dimethylbenzyl)phenyl]-2H-benzotriazole, 2-(3',5'-di-t-butyl-2'-hydroxyphenyl)benzotriazole, 2-(3'-t-butyl-5'-methyl-2'-hydroxyphenyl)-5-chlorobenzotriazole, 2-(3',5'-di-t-butyl-2'-hydroxyphenyl)-5-chlorobenzotriazole, 2-(3',5'-di-t-amyl-2-hydroxyphenyl)benzotriazole, 2-(5'-t-butyl-2'-hydroxyphenyl)benzotriazole, 2-(2'-hydroxy-5'-methylphenyl)benzotriazole, 2-(2'-hydroxy-5'-t-octylphenyl) benzotriazole, and 2-[2'-hydroxy-3'-(3",4"-5",6"tetrahydrophthalidemethyl)-5'-methylphenyl] benzotriazole; and the gallic acid-based compound is at least one member selected from the group consisting of gallic acid, linear or branched $C_1$-$C_{22}$ alkyl esters of gallic acid, and $C_4$-$C_8$ cycloalkyl esters of gallic acid.

Item 23. A lubricating oil for bearings according to Item 20, wherein said at least one member selected from the group consisting of a benzotriazole-based compound and a gallic acid-based compounds is:

beuzotriazole+(n-propyl)gallate
benzotriazole+(n-octyl)gallate,
benzotriazole+(n-dodecyl)gallate,
5-methyl-1H-benzotriazole+(n-propyl)gallate,
5-methyl-1H-benzotriazole+(n-octyl)gallate, or
5-methyl-1H-benzotriazole+(n-dodecyl)gallate.

Item 24. A lubricating oil for bearings according to Item 1, which has a kinematic viscosity at 40° C. of 5-10 $mm^2/s$ and a kinematic viscosity at 0° C. of 15-40 $mm^2/s$.

DETAILED DESCRIPTION OF THE INVENTION

Component (a): Diester Represented by General Formula (1)

The diester represented by General Formula (1) of the present invention (hereunder, referred to as "the present ester") is an ester compound obtained by esterifying a certain acid component, i.e., a linear saturated aliphatic monocarboxylic acid represented by General Formula $R^1COOH$ or $R^2COOH$ (wherein $R^1$ and $R^2$ are as defined above), or a mixture of such carboxylic acids, with an alcohol component represented by General Formula (2)

HO-A-OH (2)

wherein A represents a $C_2$-$C_{10}$ (particularly $C_3$-$C_{10}$) linear aliphatic dihydric alcohol residue or branched aliphatic dihydric alcohol residue having one or more branches according to a conventional method, preferably under a nitrogen or other inert gas atmosphere, in the presence or absence of an esterification catalyst with stirring and heating.

<Acid Components>

Examples of acid components of the present ester are $C_4$-$C_{18}$ saturated aliphatic linear monocarboxylic acids, i.e., monocarboxylic acids represented by General Formula $R^1COOH$ or $R^2COOH$ (wherein $R^1$ and $R^2$ represent a $C_3$-$C_{17}$ linear alkyl group), and more specifically include, n-butanoic acid, n-pentanoic acid, n-hexanoic acid, n-heptanoic acid, n-octanoic acid, n-nonanoic acid, n-decanoic acid, n-undecanoic acid, n-dodecanoic acid, n-tridecanoic acid, n-tetradecanoic acid, n-entadecanoic acid, n-hexadecanoic acid, n-heptadecanoic acid, and n-octadecanoic acid.

Among these, $C_4$-$C_{12}$ saturated aliphatic linear monocarboxylic acids, i.e., monocarboxylic acids represented by General Formula $R^1COOH$ or $R^2COOH$ (wherein $R^1$ and $R^2$ are $C_3$-$C_{11}$ linear alkyl groups), are preferable.

Because of the ability to impart excellent fluidity and low viscosity at low temperatures, $C_4$-$C_9$ saturated aliphatic linear monocarboxylic acids, i.e., monocarboxylic acids represented by General Formula $R^1COOH$ or $R^2COOH$ (wherein $R^1$ and $R^2$ are $C_3$-$C_8$ linear alkyl groups), are preferable. Specific examples of preferable acids include n-butanoic acid, n-pentanoic acid, n-hexanoic acid, n-heptanoic acid, n-octanoic acid, and n-nonanoic acid. Furthermore, because of imparting excellent heat resistance, $C_8$-$C_{12}$ saturated aliphatic linear monocarboxylic acids, i.e., monocarboxylic acids represented by General Formula $R^1COOH$ or $R^2COOH$ (wherein $R^1$ and $R^2$ represent $C_7$-$C_{11}$ linear alkyl groups), i.e., n-octanoic acid, n-nonanoic acid, n-decanoic acid, n-undecanoic acid, and n-dodecanoic acid are preferable.

Among these, $C_7$-$C_{10}$ saturated aliphatic linear monocarboxylic acids, i.e., monocarboxylic acids represented by General Formula $R^1COOH$ or $R^2COOH$ (wherein $R^1$ and $R^2$ represent $C_6$-$C_9$ linear alkyl groups), are especially preferable. Specific examples of especially preferable monocarboxylic acids are n-heptanoic acid, n-octanoic acid, n-nonanoic acid, and n-decanoic acid.

The above-exemplified acid components may be used singly or in combination of two or more. If two or more acids are used, the resulting ester contains a mixed ester containing acyl groups derived from two or more acids in the molecule.

When acid component has less than 4 carbon atoms, the resulting ester tend to have an increased evaporation amount. On the other hand, when the number of carbon atoms exceeds 18, the viscosity at low temperatures tends to increase.

<Alcohol Component>

In General Formula (1), dihydric alcohol residue A represents a residue (bivalent group) obtained by removing two hydroxy groups from the aliphatic dihydric alcohol represented by General Formula (2). Specifically, A represents a $C_2$-$C_{10}$ (in particular, $C_3$-$C_{10}$) linear alkylene group. Alternatively, A represents a branched alkylene group consisting of a linear alkylene group, which is the principal chain, and one or more alkyl groups (branches) bonded to the linear alkylene group, wherein the total number of carbon atoms of the linear alkylene group and the one or more alkyl groups is 2 to 10 (in particular, 3 to 10). However, when A is a branched alkylene group and has two or more alkyl groups, the two or more alkyl groups are not bonded to the same carbon atom.

In other words, A is a $C_2$-$C_{10}$, and in particular, $C_3$-$C_{10}$, linear alkylene group, or a mono- or poly-alkyl substituted linear alkylene group, wherein the total number of carbon atoms of the mono or polyalkyl substituents and the linear alkylene group is 2 to 10, and in particular, 3 to 10.

When A is a branched alkyl group, it is preferable that the number of the branch, i.e., alkyl group be one or two, and in particular, one.

Examples of alcohol components comprising such a residue A include $C_2$-$C_{10}$, and in particular $C_3$-$C_{10}$, aliphatic dihydric alcohols, in particular, saturated aliphatic dihydric alcohols, which may have one or two branches. However, when the dihydric alcohol has two or more branches (i.e., alkyl groups), the two or more branches (i.e., alkyl groups) are not bonded to the same carbon atom. Therefore, the alcohol component does not include 2,2-dimethylpropanediol (neopentyl glycol), 2,2-diethylpropanediol, 2-butyl-2-ethylpropanediol and like dihydric alcohols comprising a neopentyl structure in the molecules.

Specific examples of alcohol components include ethylene glycol, 1,2-propanediol, 1,3-propanediol, 2-methyl-1,3-propanediol, 1,3-butanediol, 1,4-butanediol, 2-methyl-1,4-butanediol, 1,4-pentanediol, 1,5-pentanediol, 2-methyl-1,5-pentanediol, 3-methyl-1,5-pentanediol, 1,5-hexanediol, 1,6-hexanediol, 2-methyl-1,6-hexanediol, 3-methyl-1,6-hexanediol, 1,6-heptanediol, 1,7-heptanediol, 2-methyl-1,7-heptanediol, 3-methyl-1,7-heptanediol, 4-methyl-1,7-heptanediol, 1,7-octanediol, 1,8-octanediol, 2-methyl-1,8-octanediol, 3-methyl-1,8-octanediol, 4-methyl-1,8-octanediol, 1,8-nonanediol, 1,9-nonanediol, 2-methyl-1,9-nonanediol, 3-methyl-1,9-nonanediol, 4-methyl-1,9-nonanediol, 5-methyl-1,9-nonanediol, 1,10-decanediol, 2-ethyl-1,3-hexanediol, 2,4-diethyl-1,5-pentanediol, etc. The above alcohol components can be used singly in esterification or in a combination of two or more alcohols.

Among these, from the standpoint of imparting excellent heat resistance and low temperature fluidity, $C_4$-$C_6$ aliphatic dihydric alcohols having one or two branches are preferable, and $C_4$-$C_6$ aliphatic dihydric alcohols having one branch are especially preferable. Specific examples include 2-methyl-1,3-propanediol, 1,3-butanediol, 2-methyl-1,4-butanediol, 1,4-pentanediol, 2-methyl-1,5-pentanediol, 3-methyl-1,5-pentanediol, 1,5-hexanediol, etc. Among these, 3-methyl-1,5-pentanediol is particularly preferable.

<Esterification Reaction>

In the esterification reaction, for example, 2.0 to 3.0 moles, preferably 2.01 to 2.5 moles, of an acid component is used per mole of an alcohol component.

Examples of esterification catalysts include Lewis acids, alkali metals, sulfonic acids, etc. Specific examples of Lewis acids include aluminum derivatives, tin derivatives, and titanium derivatives. Examples of alkali metal derivatives are sodium alkoxides, potassium alkoxides, etc. Examples of sulfonic acids include p-toluenesulfonic acid, methanesulfonic acid, sulfuric acid, etc. The amount to be used is, for example, 0.05 to 1.0 wt % based on the total amount of raw material acid and alcohol.

The preferable temperature for esterification is in the range of from 150 to 230° C., and the reaction is usually completed in 3 to 30 hours.

In the esterification, the water produced may be discharged from the reaction system by an azeotropic distillation using a solvent such as benzene, toluene, xylene or cyclohexane.

After completion of the esterification reaction, excess starting materials are evaporated under reduced pressure or atmospheric pressure. Subsequently, the resultant ester is purified using a conventional purification method, for example, neutralization, washing with water, liquid-liquid extraction, distillation under reduced pressure, adsorption purification such as treatment with activated carbon, etc.

<Preferable Diesters>

Among the present esters, preferable diesters include diesters of a $C_7$-$C_{10}$ saturated aliphatic linear monocarboxylic acid with 2-methyl-1,3-propanediol, 1,3-butanediol, 2-methyl-1,4-butanediol, 1,4-pentanediol, 2-methyl-1,5-pentanediol, 3-methyl-1,5-pentanediol or 1,5-hexanediol.

Specific examples of diesters of 2-methyl-1,3-propanediol with a $C_7$-$C_{10}$ saturated aliphatic linear monocarboxylic acid include 2-methyl-1,3-propanediol di(n-heptanoate), 2-methyl-1,3-propanediol di(n-octanoate), 2-methyl-1,3-propanediol di(n-nonanoate), and 2-methyl-1,3-propanediol di(n-decanoate).

Specific examples of diesters of 1,3-butanediol with a $C_7$-$C_{10}$ saturated aliphatic linear monocarboxylic acid include 1,3-butanediol di(n-heptanoate), 1,3-butanediol di(n-octanoate), 1,3-butanediol di(n-nonanoate), and 1,3-butanediol di(n-decanoate).

Specific examples of diesters of 2-ethyl-1,4-butanediol with a $C_7$-$C_{10}$ saturated aliphatic linear monocarboxylic acid include 2-methyl-1,4-butanediol di(n-heptanoate), 2-methyl-1,4-butanediol di(n-octanoate), 2-methyl-1,4-butanediol di(n-nonanoate), and 2-methyl-1,4-butanediol di(n-decanoate).

Specific examples of diesters of 1,4-pentanediol with a $C_7$-$C_{10}$ saturated aliphatic linear monocarboxylic acid include 1,4-pentanediol di(n-heptanoate), 1,4-pentanediol di(n-octanoate), 1,4-pentanediol di(n-nonanoate), and 1,4-pentanediol di(n-decanoate).

Specific examples of diesters of 2-methyl-1,5-pentanediol with a $C_7$-$C_{10}$ saturated aliphatic linear monocarboxylic acid include 2-methyl-1,5-pentanediol di(n-heptanoate), 2-methyl-1,5-pentanediol di(n-octanoate), 2-methyl-1,5-pentanediol di(n-nonanoate), and 2-methyl-1,5-pentanediol di(n-decanoate).

Specific examples of diesters of 3-methyl-1,5-pentanediol with a $C_7$-$C_{10}$ saturated aliphatic linear monocarboxylic acid include 3-methyl-1,5-pentanediol di(n-heptanoate), 3-methyl-1,5-pentanediol di(n-octanoate), 3-methyl-1,5-pentanediol di(n-nonanoate), and 3-methyl-1,5-pentanediol di(n-decanoate).

Specific examples of diesters of 1,5-hexanediol with a $C_7$-$C_{10}$ saturated aliphatic linear monocarboxylic acid include 1,5-hexanediol di(n-heptanoate), 1,5-hexanediol di(n-octanoate), 1,5-hexanediol di(n-nonanoate), and 1,5-hexanediol di(n-decanoate).

Among the above-mentioned preferable diesters, diesters of 3-methyl-1,5-pentanediol and a $C_7$-$C_{10}$ saturated aliphatic linear monocarboxylic acid are especially preferable. Because of their excellent low temperature fluidity, 3-methyl-1,5-pentanediol di(n-heptanoate), 3-methyl-1,5-pentanediol di(n-octanoate), and 3-methyl-1,5-pentanediol di(n-nonanoate) are especially preferable. In view of their excellent heat resistance, 3-methyl-1,5-pentanediol di(n-octanoate), 3-methyl-1,5-pentanediol di(n-nonanoate), and 3-methyl-1,5-pentanediol di(n-decanoate) are especially preferable.

Furthermore, 3-methyl-1,5-pentanediol di(n-octanoate) and 3-methyl-1,5-pentanediol di(n-nonanoate) are especially preferable because they have well-balanced heat resistance and low temperature fluidity.

Among the present esters, diesters obtained from two kinds of fatty acids selected from $C_7$-$C_{10}$ saturated aliphatic linear monocarboxylic acids and one kind of dihydric alcohol selected from the group consisting of 2-methyl-1,3-propanediol, 1,3-butanediol, 2-methyl-1,4-butanediol, 1,4-pentanediol, 2-methyl-1,5-pentanediol, 3-methyl-1,5-pentanediol and 1,5-hexanediol are also preferable. Such diesters produced from two kinds of fatty acids and a dihydric alcohol are usually a mixture of esters comprising a mixed diester having two different ester groups, a diester whose two ester groups are derived from one of the two fatty acids used, and a diester whose two ester groups are derived from the other of the two fatty acids used. Such a mixture of esters may be used as they are, and it is also possible to use only the mixed diester after separating it from such a mixture.

Preferable examples of diesters prepared using two types of fatty acids and 2-methyl-1,3-propanediol include diesters prepared from 2-methyl-1,3-propanediol and n-heptanoic acid and n-octanoic acid; diesters prepared from 2-methyl-1,3-propanediol and n-heptanoic acid and n-nonanoic acid; diesters prepared from 2-methyl-1,3-propanediol and n-heptanoic acid and n-decanoic acid; diesters prepared from 2-methyl-1,3-propanediol and n-octanoic acid and n-nonanoic acid; diesters prepared from 2-methyl-1,3-propanediol and n-octanoic acid and n-decanoic acid; diesters of 2-methyl-1,3-propanediol with n-nonanoic acid and n-decanoic acid; etc.

Preferable examples of diesters prepared using two kinds of fatty acids and 1,3-butanediol include diesters prepared from 1,3-butanediol and n-heptanoic acid and n-octanoic acid, diesters prepared from 1,3-butanediol and n-heptanoic acid and n-nonanoic acid, diesters prepared from 1,3-butanediol and n-heptanoic acid and n-decanoic acid, diesters prepared from 1,3-butanediol and n-octanoic acid and n-nonanoic acid, diesters prepared from 1,3-butanediol and n-octanoic acid and n-decanoic acid, and diesters of 1,3-butanediol with n-nonanoic acid and n-decanoic acid.

Preferable examples of diesters using two kinds of fatty acids and 2-methyl-1,4-butanediol include diesters prepared from 2-methyl-1,4-butanediol and n-heptanoic acid and n-octanoic acid; diesters prepared from 2-methyl-1,4-butanediol and n-heptanoic acid and n-nonanoic acid, diesters prepared from 2-methyl-1,4-butanediol and n-heptanoic acid and n-decanoic acid; diesters prepared from 2-methyl-1,4-butanediol and n-octanoic acid and n-nonanoic acid; diesters prepared from 2-methyl-1,4-butanediol and n-octanoic acid and n-decanoic acid; and diesters prepared from 2-methyl-1,4-butanediol and n-nonanoic acid and n-decanoic acid.

Preferable examples of diesters prepared using two kinds of fatty acids and 1,4-pentanediol include diesters prepared from 1,4-pentanediol and n-heptanoic acid and n-octanoic acid; diesters prepared from 1,4-pentanediol and n-heptanoic acid and n-nonanoic acid; diesters prepared from 1,4-pentanediol and n-heptanoic acid and n-decanoic acid; diesters prepared from 1,4-pentanediol and n-octanoic acid and n-nonanoic acid; diesters prepared from 1,4-pentanediol and n-octanoic acid and n-decanoic acid; and diesters prepared from 1,4-pentanediol and n-nonanoic acid and n-decanoic acid.

Preferable examples of diesters prepared using two kinds of fatty acids and 2-methyl-1,5-pentanediol include diesters prepared from 2-methyl-1,5-pentanediol and n-heptanoic acid and n-octanoic acid; diesters prepared from 2-methyl-1,5-pentanediol and n-heptanoic acid and n-nonanoic acid; diesters prepared from 2-methyl-1,5-pentanediol and n-heptanoic acid and n-decanoic acid; diesters prepared from 2-methyl-1,5-pentanediol and n-octanoic acid and n-nonanoic acid; diesters prepared from 2-methyl-1,5-pentanediol and n-octanoic acid and n-decanoic acid; and diesters prepared from 2-methyl-1,5-pentanediol and n-nonanoic acid and n-decanoic acid.

Preferable examples of diesters prepared using two kinds of fatty acids and 3-methyl-1,5-pentanediol include diesters prepared from 3-methyl-1,5-pentanediol and n-heptanoic acid and n-octanoic acid; diesters prepared from 3-methyl-1,5-pentanediol and n-heptanoic acid and n-nonanoic acid; diesters prepared from 3-methyl-1,5-pentanediol and n-heptanoic acid and n-decanoic acid, diesters prepared from 3-methyl-1,5-pentanediol and n-octanoic acid and n-nonanoic acid; diesters prepared from 3-methyl-1,5-pentanediol and n-octanoic acid and n-decanoic acid; and diesters prepared from 3-methyl-1,5-pentanediol and n-nonanoic acid and n-decanoic acid.

Preferable examples of diesters prepared using two kinds of fatty acids and 1,5-hexanediol include diesters prepared from 1,5-hexanediol and n-heptanoic acid and n-octanoic acid; diesters prepared from 1,5-hexanediol and n-heptanoic acid and n-nonanoic acid; diesters prepared from 1,5-hexanediol and n-heptanoic acid and n-decanoic acid; diesters prepared from 1,5-hexanediol and n-octanoic acid and n-nonanoic acid; diesters prepared from 1,5-hexanediol and n-octanoic acid and n-decanoic acid; and diesters prepared from 1,5-hexanediol and n-nonanoic acid and n-decanoic acid.

Among the above preferable diesters prepared using two kinds of fatty acids, esters prepared using 3-methyl-1,5-pentanediol and two kinds of fatty acids selected from $C_7$-$C_{10}$ saturated aliphatic linear monocarboxylic acids are especially preferable. Because of their excellent low temperature fluidity, diesters prepared from 3-methyl-1,5-pentanediol and n-heptanoic acid and n-octanoic acid, diesters prepared from 3-methyl-1,5-pentanediol and n-heptanoic acid and n-nonanoic acid; diesters prepared from 3-methyl-1,5-pentanediol and n-heptanoic acid and n-decanoic acid, diesters prepared from 3-methyl-1,5-pentanediol and n-octanoic acid and n-nonanoic acid; and diesters prepared from 3-methyl-1,5-pentanediol and n-octanoic acid and n-decanoic acid are preferable. In view of the excellent heat resistance, diesters prepared from 3-methyl-1,5-pentanediol and n-octanoic acid and n-nonanoic acid; diesters prepared from 3-methyl-1,5-pentanediol and n-octanoic acid and n-decanoic acid; and diesters prepared from 3-methyl-1,5-pentanediol and n-nonanoic acid and n-decanoic acid are preferable. Furthermore, diesters prepared from 3-methyl-1,5-pentanediol and n-octanoic acid and n-nonanoic acid, and diesters prepared from 3-methyl-1,5-pentanediol and n-octanoic acid and n-decanoic acid are especially preferable because they have well-balanced heat resistance and low temperature fluidity.

A lubricating oil of the present invention comprises one or more of the present esters.

The total acid number of the present ester is usually 0.1 mg KOH/g or less, and preferably 0.05 mg KOH/g or less. If the total acid number is 0.1 mg KOH/g or less, the ester exhibits well-balanced heat resistance and lubricating ability. It is possible to control the total acid number by neutralization.

The hydroxyl value of the present ester is usually 5 mg KOH/g or less, preferably 3 mg KOH/g or less, and more preferably 1 mg KOH/g or less. If the hydroxyl value is 5 mg KOH/g or less, the heat resistance is improved. It is possible to control the hydroxyl value by satisfactorily reducing any residual hydroxy groups during the reaction.

The sulfated ash content in the present ester is preferably 30 ppm or less, and more preferably 10 ppm or less. If the sulfated ash content is 30 ppm or less, the heat resistance is improved. When acids and/or alcohols containing a low sulfated ash content (e.g., 30 ppm or less) are used as the starting materials for the present ester, and a metal catalyst is used as the catalyst, the sulfated ash content can be controlled by satisfactorily removing the catalyst and organometallic compounds derived from the catalyst by neutralization, washing with water, and purification by adsorption.

The iodine value of the present ester is usually 1 or less, preferably 0.5 or less, and more preferably 0.1 or less. If the iodine value is 1 or less, the heat resistance is improved. The iodine value can be controlled by using acids and/or alcohols having a small iodine value (e.g., 0.3 or less). It is also possible to control the iodine value by reducing (hydrogenating) purified esters having an iodine value of 1 or more.

Among the present esters, those having a molecular weight of 320-400, and preferably 330-380, are recommended because of their low kinematic viscosity at 0° C. and excellent heat resistance. Among the present esters, those having a pour point, as defined by JIS-K-2269, of −20° C. or less are preferable. To be suitable for use at low temperatures, the esters more preferably have a pour point of −30° C. or less, and most preferably −40° C. or less.

Preferable among the present esters are those having a viscosity index as defined by JIS-K-2283 of 150 or more, more preferably 160 or more, and still more preferably 170 or more. Those esters having a viscosity index of 150 or more have a low viscosity over a wide temperature range and excellent heat resistance.

<Amount of the Present Ester Used>

The amount of the present ester used may be selected from a wide range, and is preferably 99.99 to 95 wt %, and more preferably 99.9 to 98 wt %, of the lubricating oil for bearings of the present invention, i.e., of the total amount of component (a) and component (b).

Component (b): Phenol-based Antioxidant and Amine-based Antioxidant

<Phenol-based Antioxidant>

Various known antioxidants used in the art can be used without limitation as phenol-based antioxidants of the present invention. Among these phenol-based antioxidants, those containing no sulfur atoms in the molecule and having 6 to 100 carbon atoms, preferably 10 to 80 carbon atoms, are preferred.

Specific examples include 2,6-di-t-butyl phenol, 2,6-di-t-butyl-p-cresol, 4,4'-methylenebis(2,6-di-t-butylphenol), 4,4'-butylidenebis(3-methyl-6-t-butylphenol), 2,2'-methylenebis(4-ethyl-6-t-butylphenol), 2,2'-methylenebis(4-methyl-6-t-butylphenol), 4,4'-isopropylidenebisphenol, 2,4-dimethyl-6-t-butylphenol, tetrakis[methylene-3-(3,5-di-t-butyl-4-hydroxyphenyl)propionate]methane, 1,1,3-tris(2-methyl-4-hydroxy-5-t-butylphenyl)butane, 1,3,5-trimethyl-2,4,6-tris(3,5-di-t-butyl-4-hydroxybenzyl)-benzene, 2,2'-dihydroxy-3,3'-di(α-methylcyclohexyl)-5,5'-dimethyl-diphenylmethane, 2,2'-isobutylidenebis(4,6-dimethylphenol), 2,6-bis(2'-hydroxy-3'-t-butyl-5'-methylbenzyl)-4-methylphenol, 1,1'-bis(4-hydroxyphenyl) cyclohexane, 2,5-di-t-amylhydroquinone, 2,5-di-t-butylhydroquinone, 1,4-dihydroxyanthraquinone, 3-t-butyl-4-hydroxyanisole, 2-t-butyl-4-hydroxyanisole, 2,4-dibenzoylresorcinol, 4-t-butylcatechol, 2,6-di-t-butyl-4-ethylphenol, 2-hydroxy-4-methoxybenzophenone, 2,4-dihydroxybenzophenone, 2,2'-dihydroxy-4-methoxybenzophenone, 2,4,5-trihydroxybenzophenone, α-tocopherol, bis[2-(2-hydroxy-5-methyl-3-t-butylbenzyl)-4-methyl-6-t-butylphenyl]terephthalate, triethylene glycol bis[3-t-butyl-5-methyl-4-hydroxyphenyl)propionate], 1,6-hexanediol-bis[3-(3,5-di-t-butyl-4-hydroxyphenyl)propionate], etc.

Among these, 2,6-di-t-butylphenol, 2,6-di-t-butyl-p-cresol, 4,4'-methylenebis(2,6-di-t-butylphenol), 4,4'-butylidenebis(3-methyl-6-t-butylphenol), 2,2'-methylenebis(4-ethyl-6-t-butylphenol), 2,2'-methylenebis(4-methyl-6-t-butylphenol), 4,4'-isopropylidenebisphenol, 2,4-dimethyl-6-t-butylphenol, tetrakis[methylene-3-(3,5-di-t-butyl-4-hydroxyphenyl)-propionate]methane, 1,1,3-tris(2-methyl-4-hydroxy-5-t-butylphenyl)butane, 1,3,5-trimethyl-2,4,6-tris(3,5-di-t-butyl-4-hydroxybenzyl)-benzene, 2,6-di-t-butyl-4-ethylphenol, bis[2-(2-hydroxy-5-methyl-3-t-butylbenzyl)-4-methyl-6-t-butylphenyl]terephthalate, triethylene glycol bis[3-(3-t-butyl-5-methyl-4-hydroxyphenyl)propionate], and 1,6-hexanediol-bis[3-(3,5-di-t-butyl-4-hydroxyphenyl)propionate] are preferable, and 2,6-di-t-butyl-p-cresol, 4,4'-methylenebis(2,6-di-t-butylphenol), and 2,6-di-t-butyl-4-ethylphenol are most preferable.

Such phenol-based antioxidants may be used singly or in combination of two or more, and the amount is usually 0.01 to 5 wt %, and preferably 0.1 to 2 wt %, of the lubricating oil for bearings, i.e., of the total amount of component (a) and component (b).

<Amine-based Antioxidant>

As the amine-based antioxidant of the present invention, it is possible to use various known antioxidants used in the art without limitation. Among such amine-based antioxidants, those containing no sulfur atoms in the molecule and having 6 to 60 carbon atoms, and preferably 10 to 40 carbon atoms, are preferred.

Specific examples include diphenylamines such as diphenylamine, monobutyl (including linear and branched) diphenylamines, monopentyl (including linear and branched) diphenylamines, monohexyl (including linear and branched) diphenylamines, monoheptyl (including linear and branched) diphenylamines, monooctyl (including linear and branched) diphenylamines and like monoalkyl diphenylamines, in particular, mono($C_4$-$C_9$ alkyl)diphenylamines (i.e., diphenylamines wherein one of the two benzene rings is mono-substituted with an alkyl group, in particular, a $C_4$-$C_9$ alkyl group, i.e., a monoalkyl-substituted diphenylamines); p,p'-dibutyl (including linear and branched) diphenylamines, p,p'-dipentyl (including linear and branched) diphenylamines, p,p'-dihexyl (including linear and branched) diphenylamines, p,p'-diheptyl (including linear and branched) diphenylamines, p,p'-dioctyl (including linear and branched) diphenylamines, p,p'-dinonyl (including linear and branched) diphenylamines and like di(alkylphenyl)amines, in particular, p,p'-di($C_4$-$C_9$ alkylphenyl)amines (i.e., dialkyl substituted diphenylamines wherein each of the benzene rings is mono-substituted with an alkyl group, in particular, a $C_4$-$C_9$ alkyl group, and the two alkyl groups are identical); di(mono $C_4$-$C_9$ alkylphenyl) amines wherein the alkyl group on one of the benzene rings is different from the alkyl group on the other of the benzene rings; di(di-$C_4$-$C_9$ alkylphenyl)amines wherein at least one of the four alkyl groups of the two benzene rings is different from the rest of the alkyl groups; naphthylamines such as N-phenyl-1-naphthylamine, N-phenyl-2-naphthylamine, 4-octylphenyl-1-naphthylamine, 4-octylphenyl-2-naphthylamine and the like; phenylenediamines such as p-phenylenediamine, N-phenyl-N'-isopropyl-p-phenylenediamine, N-phenyl-N'-(1,3-dimethylbutyl)-p-phenylenediamine and the like. Among these, p,p'-dioctyl (including linear and branched) diphenylamine, p,p'-dinonyl (including linear and branched) diphenylamine, and N-phenyl-1-naphthylamine are preferable.

Note that in the present specification, "(including linear and branched)" means including either or both of linear alkyl and branched alkyl.

Amine-based antioxidants may be used singly or in combination of two or more. The amount of the amine-based antioxidant is usually 0.01 to 5 wt %, and preferably 0.1 to 2 wt %, of the lubricating oil for bearings, i.e., of the total amount of component (a) and component (b).

<Combination of Phenol-based Antioxidant and Amine-based Antioxidant>

One or more phenol-based antioxidants and one or more amine-based antioxidants of the present invention may be used in combination.

The ratio of phenol-based antioxidant(s) to amine-based antioxidant(s) can be suitably selected from a wide range, and the weight ratio of the phenol-based antioxidant (I) to the amine-based antioxidant (II) is preferably I:II=1:0.05 to 20, and more preferably 1:0.2 to 5.

Examples of preferable combinations include one or more members selected from the group consisting of 2,6-di-t-butyl-p-cresol, 4,4'-methylenebis(2,6-di-t-butylphenol), and 2,6-di-t-butyl-4-ethylphenol with one or more members selected from the group consisting of p,p'-dioctyl (including linear and branched) diphenylamine, p,p'-dinonyl (including linear and branched) diphenylamine and N-phenyl-1-naphthylamine.

Specifically, the following combinations are preferable:

2,6-di-t-butyl-p-cresol+p,p'-dioctyl (including linear and branched) diphenylamine, 2,6-di-t-butyl-p-cresol+p,p'-dinonyl (including linear and branched) diphenylamine, 2,6-di-t-butyl-p-cresol+N-phenyl-1-naphthylamine, 4,4'-methylenebis(2,6-di-t-butylphenol)+p,p'-dioctyl (including linear and branched) diphenylamine, 4,4'-methylenebis(2,6-di-t-butylphenol)+p,p'-dinonyl (including linear and branched) diphenylamine, 4,4'-methylenebis(2,6-di-t-butylphenol)+N-phenyl-1-naphthylamine, 2,6-di-t-butyl-4-ethylphenol+p,p'-dioctyl (including linear and branched) diphenylamine, 2,6-di-t-butyl-4-ethylphenol+p,p'-dinonyl (including linear and branched) diphenylamine, 2,6-di-t-butyl-4-ethylphenol+N-phenyl-1-naphthylamine, etc.

Among these, the following combinations are recommended as more effective combinations because of their excellent heat resistance:

4,4'-methylenebis(2,6-di-t-butylphenol)+p,p'-dioctyl (including linear and branched) diphenylamine, 4,4'-methylenebis(2,6-di-t-butylphenol)+p,p'-dinonyl (including linear and branched) diphenylamine, 4,4'-methylenebis(2,6-di-t-butylphenol)+N-phenyl-1-naphthylamine, etc.

The total amount of phenol-based antioxidant and amine-based antioxidant is usually 0.01 to 5 wt %, and preferably 0.1 to 2 wt %, of the lubricating oil for bearings, i.e., of the total amount of component (a) and component (b).

Component (c): Phosphorus-based Compound and Aliphatic Linear Monocarboxylic Acid The lubricating ability of the lubricating oil for bearings of the present invention can, if necessary, be further improved by adding at least one member selected from the group consisting of phosphorus-based compounds and aliphatic linear monocarboxylic acids.

<Phosphorus-based Compound>

Various known phosphorus-based compounds used in this field can be used as phosphorus-based compounds, and those containing no sulfur atoms in the molecule and having 12 to 70 carbon atoms, particularly 12 to 50 carbon atoms, are preferable.

Specific examples include phosphoric acid triesters and phosphorous acid triesters.

Examples of phosphoric acid triesters include tributyl (including linear and branched) phosphate, triheptyl (including linear and branched) phosphate, trioctyl (including linear and branched) phosphate, trinonyl (including linear and branched) phosphate, tridecyl (including linear and branched) phosphate, triundecyl (including linear and branched) phosphate, tridodecyl (including linear and branched) phosphate, tritridecyl (including linear and branched) phosphate, tritetradecyl (including linear and branched) phosphate, tripentadecyl (including linear and branched) phosphate, trihexadecyl (including linear and branched) phosphate, triheptadecyl (including linear and branched) phosphate, trioctadecyl (including linear and branched) phosphates and like tri(linear or branched $C_4$-$C_{18}$ alkyl) phosphates; tricyclohexyl phosphate, tricyclopentyl phosphate and like tri($C_4$-$C_8$ cycloalkyl) phosphates; triphenyl phosphate, tricresyl phosphate, trixylenyl phosphate, cresyldiphenyl phosphate, xylenyldiphenyl phosphate, tris(tribromophenyl) phosphate, tris(dibromophenyl) phosphate, tris(2,4-di-t-butylphenyl) phosphate, tri(nonylphenyl) phosphate and like triaryl phosphates, in particular, tri(unsubstituted or substituted phenyl) phosphates (substituted phenyl group is substituted with 1 to 3 substituents selected from the group consisting of $C_1$-$C_{10}$ alkyl, halogen atom (in particular, bromine) and hydroxy group. One or two of the three phenyl groups may be unsubstituted and the rest may be substituted)

Examples of phosphorous acid triesters include tributyl (including linear and branched) phosphite, triheptyl (including linear and branched) phosphite, trioctyl (including linear and branched) phosphite, trinonyl (including linear and branched) phosphite, tridecyl (including linear and branched) phosphite, triundecyl (including linear and branched) phosphite, tridodecyl (including linear and branched) phosphite, tritridecyl (including linear and branched) phosphite, tritetradecyl (including linear and branched) phosphite, tripentadecyl (including linear and branched) phosphite, trihexadecyl (including linear and branched) phosphite, triheptadecyl (including linear and branched) phosphite, trioctadecyl (including linear and branched) phosphite and like tri(linear or branched $C_4$-$C_{18}$ alkyl) phosphites; and tricyclohexyl phosphite, tricyclopentyl phosphite and like tri($C_4$-$C_8$ cycloalkyl) phosphites; and triphenyl phosphite, tricresyl phosphite, trixylenyl phosphite, cresyldiphenyl phosphite, xylenyldiphenyl phosphite, tris(tribromophenyl) phosphite, tris(dibromophenyl) phosphite, tris(2,4-di-t-butylphenyl) phosphite, tri(nonylphenyl) phosphite and like triaryl phosphites, in particular tri(unsubstituted or substituted phenyl) phosphites (the substituted phenyl group is substituted with 1 to 3 substituents selected from the group consisting of $C_1$-$C_{10}$ alkyl, halogen atom (in particular, bromine) and hydroxy group. One or two of the three phenyl groups may be unsubstituted and the rest may be substituted); etc.

Among these, especially preferable examples are tri(n-butyl) phosphate, triisobutyl phosphate, tri(sec-butyl) phosphate, tri(n-heptyl) phosphate, triisoheptyl phosphate, tri(n-octyl) phosphate, triisooctyl phosphate, tri(n-nonyl) phosphate, triisononyl phosphate, tri(n-decyl) phosphate, triisodecyl phosphate, tri(n-ocyl) phosphate, tri(n-tetradecyl) phosphate, tri(n-hexadecyl) phosphate, tri(n-octadecyl)

phosphate and like trialkyl phosphates, particularly tri(linear or branched $C_4$-$C_{18}$ alkyl) phosphate; tricyclohexyl phosphate, tricyclopentyl phosphate and like tri($C_4$-$C_8$ cycloalkyl) phosphates; triphenyl phosphate, tricresyl phosphate, trixylenyl phosphate, cresyldiphenyl phosphate, xylenyldiphenyl phosphate, tris(tribromophenyl) phosphate, tris(dibromophenyl) phosphate, tris(2,4-di-t-butylphenyl) phosphate, tri(nonylphenyl) phosphate and like triaryl phosphates, in particular tri(unsubstituted or substituted phenyl) phosphates (the substituted phenyl group is substituted with 1 to 3 substituents selected from the group consisting of $C_1$-$C_{10}$ alkyl, halogen atom (in particular, bromine) and hydroxy group. One or two of the three phenyl groups may be unsubstituted and the rest may be substituted), and tri(n-octyl) phosphate, triphenyl phosphate, tricresyl phosphate are most preferable.

Phosphoric acid esters may be used singly or in combination of two or more, and the amount is usually 0.1 to 10 parts-by weight, and preferably 0.5 to 5 parts by weight, based on 100 parts by weight of the lubricating oil for bearings (i.e., component (a)+component (b)).

Phosphorous acid esters may be used singly or in combination of two or more, and the amount is usually 0.1 to 10 parts by weight, and preferably 0.5 to 5 parts by weight, based on 100 parts by weight of the lubricating oil for bearings (i.e., component (a)+component (b)).

Usable phosphorus-based compounds also include acid phosphates and acid phosphites. Specifically, dibutyl (including linear and branched) phosphate, diheptyl (including linear and branched) phosphate, dioctyl (including linear and branched) phosphate, dinonyl (including linear and branched) phosphate, didecyl (including linear and branched) phosphate, diundecyl (including linear and branched) phosphate, didodecyl (including linear and branched) phosphate, ditridecyl (including linear and branched) phosphate, ditetradecyl (including linear and branched) phosphate, dipentadecyl (including linear and branched) phosphate, dihexadecyl (including linear and branched) phosphate, diheptadecyl (including linear and branched) phosphate, dioctadecyl (including linear and branched) phosphate and like dialkyl phosphates, in particular di(linear or branched $C_4$-$C_{18}$ alkyl) phosphate; dicyclohexyl phosphate, dicyclopentyl phosphate and like di($C_4$-$C_8$ cycloalkyl) phosphates; diphenyl phosphate, dicresyl phosphate, dixylenyl phosphate, cresylphenyl phosphate, xylenylphenyl phosphate, bis(tribromophenyl) phosphate, bis(dibromophenyl) phosphate, bis(2,4-di-t-butylphenyl) phosphate, di(nonylphenyl) phosphate and like diaryl phosphates, in particular di(unsubstituted or substituted phenyl) phosphates (the substituted phenyl group is substituted with 1 to 3 substituents selected from the group consisting of $C_1$-$C_{10}$ alkyl, halogen atom (in particular, bromine) and hydroxy group. One of the two phenyl groups may be unsubstituted and the other may be substituted); dibutyl (including linear and branched) phosphite, diheptyl (including linear and branched) phosphite, dioctyl (including linear and branched) phosphite, dinonyl (including linear and branched) phosphite, didecyl (including linear and branched) phosphite, diundecyl (including linear and branched) phosphite, didodecyl (including linear and branched) phosphite, ditridecyl (including linear and branched) phosphite, ditetradecyl (including linear and branched) phosphite, dipentadecyl (including linear and branched) phosphite, dihexadecyl (including linear and branched) phosphite, diheptadecyl (including linear and branched) phosphite, dioctadecyl (including linear and branched) phosphite and like dialkyl phosphites, in particular di(linear or branched $C_4$-$C_{18}$ alkyl) phosphites; dicyclohexyl phosphite, dicyclopentyl phosphite and like di($C_4$-$C_8$ cycloalkyl) phosphites; diphenyl phosphite, dicresyl phosphite, dixylenyl phosphite, cresylphenyl phosphite, xylenylphenyl phosphite, bis(tribromophenyl) phosphite, bis(dibromophenyl) phosphite, bis(2,4-di-t-butylphenyl) phosphite, dinonylphenyl phosphite and like diaryl phosphites, in particular di(unsubstituted or substituted phenyl) phosphites (substituted phenyl group is substituted with 1 to 3 substituents selected from the group consisting of $C_1$-$C_{10}$ alkyl, halogen atom (in particular, bromine) and hydroxy group. One of the two phenyl groups may be unsubstituted and the other may be substituted), etc.

Among these, di(n-butyl) phosphate, diisobutyl phosphate, di(sec-butyl) phosphate, dicyclohexyl phosphate, di(n-heptyl) phosphate, diisoheptyl phosphate, di(n-octyl) phosphate, diisooctyl phosphate, di(n-nonyl) phosphate, diisononyl phosphate, di(n-decyl) phosphate, diisodecyl phosphate, di(n-dodecyl) phosphate, di(n-tetradecyl) phosphate, di(n-hexadecyl) phosphate, di(n-octadecyl) phosphate and like dialkyl phosphates, diphenyl phosphate, dicresyl phosphate, dixylenyl phosphate, cresylphenyl phosphate, xylenylphenyl phosphate, bis(tribromophenyl) phosphate, bis(dibromophenyl) phosphate, bis(2,4-di-t-butylphenyl) phosphate, dinonylphenyl phosphate and like diaryl phosphates are preferable; and di(n-octyl) phosphate, diphenyl phosphate, and dicresyl phosphate are most preferable.

Acid phosphates may be used singly or in combination of two or more, and the amount is usually 0.01 to 3 parts by weight, and preferably 0.05 to 1 part by weight, based on 100 parts by weight of the lubricating oil for bearings (i.e., component (a)+component (b)).

Acid phosphites may be used singly or in combination of two or more, and the amount is usually 0.01 to 3 parts by weight, and preferably 0.05 to 1 part by weight, based on 100 parts by weight of lubricating oil for bearings (i.e., component (a)+component (b)).

<Aliphatic Linear Monocarboxylic Acid>

Examples of aliphatic linear monocarboxylic acids include those having 12 to 22 carbon atoms, and preferably those having 14 to 18 carbon atoms. Specifically, examples are n-dodecanoic acid, n-tridecanoic acid, n-tetradecanoic acid, n-pentadecanoic acid, n-hexadecanoic acid, n-heptadecanoic acid, n-octadecanoic acid, n-nonadecanoic acid, n-icosanoic acid, n-docosanoic acid, oleic acid, etc. Among these, n-tetradecanoic acid, n-hexadecanoic acid, and n-octadecanoic acid are especially preferable. Such aliphatic linear monocarboxylic acids may be used singly or in combination of two or more, and the amount is usually 0.01 to 5 parts by weight and preferably 0.05 to 2 parts by weight, based on 100 parts by weight of the lubricating oil for bearings (i.e., component (a)+component (b)).

<Combination of a Phosphorus-based Compound and an Aliphatic Linear Monocarboxylic Acid>

One or more phosphorus-based compounds and one or more aliphatic linear monocarboxylic acids of the present invention may be used in combination.

The ratio of the phosphorus-based compound(s) to aliphatic linear monocarboxylic acid(s) can be suitably selected from a wide range, and the weight ratio of the phosphorus-based compound(s) (III) to aliphatic linear monocarboxylic acid(s) (IV) is preferably III:IV=1:0.005 to 0.2, and more preferably 1:0.01 to 0.1.

Examples of preferable combinations include combinations of at least one member selected from the group consisting of tri(n-octyl) phosphate, triphenyl phosphate and tricresyl phosphate, with one or more members selected from the group consisting of n-tetradecanoic acid, n-hexadecanoic acid and n-octadecanoic acid.

For example, the following combinations are preferable:

tri(n-octyl) phosphate+n-tetradecanoic acid tri(n-octyl) phosphate+n-hexadecanoic acid, tri(n-octyl) phosphate+n-octadecanoic acid, triphenyl phosphate+n-tetradecanoic acid, triphenyl phosphate+n-hexadecanoic acid, triphenyl phosphate+n-octadecanoic acid, tricresyl phosphate+n-tetradecanoic acid, tricresyl phosphate+n-hexadecanoic acid, tricresyl phosphate+n-octadecanoic acid, etc.

Among these, examples of especially preferable combinations having well-balanced heat resistance and lubricating ability are as follows:

tricresyl phosphate+n-tetradecanoic acid, tricresyl phosphate+n-hexadecanoic acid, tricresyl phosphate+n-octadecanoic acid, etc.

The total amount of phosphorus-based compound and aliphatic linear monocarboxylic acid is usually 0.11 to 15 parts by weight, and preferably 0.55 to 7 parts by weight, based on 100 parts by weight of the lubricating oil for bearings (i.e., component (a)+component (b)).

Component (d): Benzotriazole-based Compounds and Gallic Acid-based Compounds

If desired, the metal compatibility of the lubricating oil for bearings of the present invention can be further improved by adding at least one member selected from the group consisting of benzotriazole-based compounds and gallic acid-based compounds.

<Benzotriazole-based Compounds>

Various benzotriazole-based compounds used in the art can be employed without limitation. Among such benzotriazole-based compounds, those containing no sulfur atoms in the molecule and having 6 to 60 carbon atoms, and especially 6 to 40 carbon atoms, are preferable.

Specific examples thereof are benzotriazole, 5-methyl-1H-benzotriazole, 1-dioctylaminomethylbenzotriazole, 1-dioctylaminomethyl-5-methylbenzotriazole, 2-(5'-methyl-2'-hydroxyphenyl)benzotriazole, 2-[2'-hydroxy-3',5'-bis(α,α-dimethylbenzyl)phenyl]-2H-benzotriazole, 2-(3',5'-di-t-butyl-2'-hydroxyphenyl)benzotriazole, 2-(3'-t-butyl-5'-methyl-2'-hydroxyphenyl)-5-chlorobenzotriazole, 2-(3',5'-di-t-butyl-2'-hydroxyphenyl)-5-chlorobenzotriazole, 2-(3',5'-di-t-amyl-2'-hydroxyphenyl)benzotriazole, 2-(5'-t-butyl-2'-hydroxyphenyl)benzotriazole, 2-(2'-hydroxy-5'-methylphenyl)benzotriazole, 2-(2'-hydroxy-5'-t-octylphenyl)benzotriazole, 2-[2'-hydroxy-3'-(3",4"-5",6"tetrahydrophthalidemethyl)-5'-methylphenyl] benzotriazole, etc. Benzotriazole and 5-methyl-1H-benzotriazole are especially preferable among these.

Such benzotriazole-based compounds may be used singly or in combination of two or more, and the amount is usually 0.01 to 0.4 parts by weight, and preferably 0.01 to 0.2 parts by weight, based on 100 parts by weight of the lubricating oil for bearings (i.e., component (a)+component (b))

<Gallic Acid-based Compounds>

Examples of gallic acid-based compounds include those having 7 to 30 carbon atoms, and preferably 8 to 20 carbon atoms. Specific examples include gallic acid, methyl gallate, ethyl gallate, propyl (including linear and branched) gallate, butyl (including linear and branched) gallate, pentyl (including linear and branched) gallate, hexyl (including linear and branched) gallate, heptyl (including linear and branched) gallate, octyl (including linear and branched) gallate, nonyl (including linear and branched) gallate, decyl (including linear and branched) gallate, undecyl (including linear and branched) gallate, dodecyl (including linear and branched) gallate, tridecyl (including linear and branched) gallate, tetradecyl (including linear and branched) gallate, pentadecyl (including linear and branched) gallate, hexadecyl (including linear and branched) gallate, heptadecyl (including linear and branched) gallate, octadecyl (including linear and branched) gallate, nonadecyl (including linear and branched) gallate, icosyl (including linear and branched) gallate, docosyl (including linear and branched) gallate and like linear or branched $C_1$-$C_{22}$ alkyl esters of gallic acid; and cyclohexyl gallate, cyclopentyl gallate and like $C_4$-$C_8$ cycloalkyl esters of gallic acid. Among these, (n-propyl)gallate, (n-octyl)gallate, (n-dodecyl)gallate and like linear or branched $C_3$-$C_{12}$ alkyl esters of gallic acid are preferable.

The gallic acid-based compounds may be used singly or in combination of two or more, and the amount is usually 0.001 to 0.2 parts by weight, and preferably 0.005 to 0.05 parts by weight, based on 100 parts by weight of the lubricating oil for bearings (i.e., component (a)+component (b)).

<Combination of a Benzotriazole-based Compound and a Gallic Acid-based Compound>

One or more benzotriazole-based compounds and one or more gallic acid-based compounds of the present invention may be used in combination.

The ratio of benzotriazole-based compound(s) to gallic acid-based compound(s) can be suitably selected from a wide range without limitation, and the weight ratio of the benzotriazole-based compound(s) (V) to the gallic acid-based compound(s) (VI) is preferably, V:VI=1:0.05 to 0.5, and more preferably 1:0.1 to 0.3.

Examples of preferable combinations are as follows:

benzotriazole+(n-propyl)gallate, benzotriazole+(n-octyl)gallate, benzotriazole+(n-dodecyl)gallate, 5-methyl-1H-benzotriazolebenzotriazole+(n-propyl)gallate, 5-methyl-1H-benzotriazole+(n-octyl)gallate, 5-methyl-1H-benzotriazole+(n-dodecyl)gallate, etc.

The amount is usually 0.011 to 0.6 parts by weight, and preferably 0.015 to 0.25 parts by weight, based on 100 parts by weight of the lubricating oil for bearings (i.e., component (a)+component (b)).

Additionally Usable Base Oils

As long as the performance is not impaired, the lubricating oil for bearings of the present invention may additionally contain one or more other lubricating base oils (hereunder referred to as "additional base oil"), i.e., one or more members selected from the group consisting of mineral oils (hydrocarbon oils obtained by purification of petroleum), poly-α-olefins, polybutenes, alkylbenzenes, alkylnaphthalenes, isomerized oils of synthetic hydrocarbons obtained by a Fischer-Tropsch method and like synthetic hydrocarbon oils, animal and vegetable oils, organic acid esters, polyalkylene glycols, polyvinyl ethers, polyphenyl ethers, and alkylphenyl ethers.

Examples of mineral oils include solvent-refined mineral oils, mineral oils treated by hydrogenation, wax isomerized oil, and usable are those having a kinematic viscosity in the range of usually 1.0 to 15 $mm^2/s$, and preferably 2.0 to 10.0 $mm^2/s$, at 100° C.

Examples of poly-α-olefins include polymers or copolymers of α-olefins having 2 to 16 carbon atoms (for example, ethylene, propylene, 1-butene, 1-hexene, 1-octene, 1-decene, 1-dodecene, 1-tetradecene, 1-hexadecene, etc.) and having a kinematic viscosity of 1.0 to 15 $mm^2/s$ at 100° C., and a viscosity index of 100 or more, and in particular, a kinematic viscosity of 1.5-10.0 $mm^2/s$ at 100° C. and a viscosity index of 120 or more.

Examples of polybutenes include those obtained by polymerizing isobutylene, or obtained by copolymerizing isobutylene with normal butylene, etc., and those having a kinematic viscosity of 2.0-40 $mm^2/s$ at 100° C. are generally usable.

Examples of alkylbenzenes include monoalkylbenzenes, dialkylbenzenes, trialkylbenzenes, tetraalkylbenzenes, etc., with a molecular weight of 200-450 and substituted with $C_1$-$C_{40}$ linear or branched alkyl group (s).

Examples of alkylnaphthalenes include monoalkylnaphthalenes, dialkylnaphthalenes, etc., substituted with $C_1$-$C_{30}$ linear or branched alkyl group(s).

Examples of animal and vegetable oils include beef tallow, lard, palm oil, coconut oil, rapeseed oil, castor oil, sunflower oil, etc.

Examples of organic acid esters, other than the present ester, include fatty acid monoesters, aliphatic dibasic acid diesters, polyol esters and other esters.

Examples of fatty acid monoesters include esters of a $C_5$-$C_{22}$ aliphatic linear or branched monocarboxylic acid and a $C_3$-$C_{22}$ linear or branched saturated or unsaturated aliphatic alcohol.

Examples of aliphatic dibasic acid diesters include esters of a $C_3$-$C_{22}$ linear or branched saturated or unsaturated aliphatic alcohol with an aliphatic dibasic acid such as oxalic acid, malonic acid, succinic acid, glutaric acid, adipic acid, pimelic acid, suberic acid, azelaic acid, sebacic acid, 1,9-nonamethylenedicarboxylic acid, 1,10-decamethylenedicarboxylic acid and the like or an anhydride thereof.

For polyolesters, it is possible to use esters of a neopentyl polyol such as neopentyl glycol, trimethylolpropane, pentaerythritol, ditrimethylolpropane or dipentaerythritol with a $C_3$-$C_{22}$ linear or branched saturated or unsaturated fatty acid.

Examples of other esters include esters of a polymerized fatty acid such as dimer acids, hydrogenated dimer acids or the like with a $C_3$-$C_{22}$ linear or branched saturated or unsaturated aliphatic alcohols.

Examples of polyalkylene glycols include a polymer prepared from an alcohol and one or more $C_2$-$C_4$ linear or branched alkylene oxides by ring-opening polymerization. Examples of alkylene oxides include ethylene oxide, propylene oxide, and butylene oxides; and it is possible to use polymers prepared from one of these, or copolymers prepared from a mixture of two or more of these. It is also possible to use such compounds wherein the hydroxy group(s) at one or both ends are etherified or esterified. The kinematic viscosity of the polymer is usually 5.0-1000 $mm^2/s$ (40° C.), and preferably 5.0-500 $mm^2/s$ (40° C.).

Polyvinyl ethers are compounds obtained by polymerizing a vinyl ether monomer, such as methyl vinyl ether, ethyl vinyl ether, isopropyl vinyl ether, n-butyl vinyl ether, isobutyl vinyl ether, sec-butyl vinyl ether, tert-butyl vinyl ether, n-pentyl vinyl ether, n-hexyl vinyl ether, 2-ethoxyethyl vinyl ether, 2-ethoxyethyl vinyl ether, etc. The kinematic viscosity of the polymer is usually 5.0-1000 $mm^2/s$ (40° C.), and preferably 5.0-500 $mm^2/s$ (40° C.).

Examples of polyphenyl ethers include compounds having a structure wherein the meta positions of two or more aromatic rings are connected by ether linkages or thioether linkages, specifically, bis(m-phenoxyphenyl)ether, m-bis(m-phenoxyphenoxy)benzene, and thioethers (so called C-ethers) wherein one or more oxygen atoms thereof are replaced by one or more sulfur atoms, etc.

Examples of alkylphenyl ethers include compounds wherein a polyphenyl ether is substituted with $C_6$-$C_{18}$ linear or branched alkyl group (s), and alkyldiphenyl ethers substituted with one or more alkyl groups are preferable.

When such additional base oils are used in combination with the lubricating oil of the present invention, the additional base oil partially replaces the diester represented by General Formula (1) used in the present invention. In other words, in the lubricating oil of the present invention, it is possible to use only the diester(s) represented by General Formula (1) as the base oil, or a mixture of the diester(s) represented by General Formula (1) and the additional base oil(s). In such a mixture, the concentration of the additional base oil(s) is usually 5-60 wt %, and preferably 5-20 wt %, of the total amount of the diester(s) represented by General Formula (1) and the additional base oil(s).

Among the additional base oils, because of their excellent heat resistance and lubricating ability, organic acid esters are preferable, and because of the well-balanced heat resistance and low temperature viscosity, fatty acid monoesters, aliphatic dibasic acid diesters and polyol esters are preferable.

Examples of especially preferable fatty acid monoesters are esters of a $C_{12}$-$C_{18}$ aliphatic linear monocarboxylic acid with a $C_8$-$C_{10}$ saturated aliphatic linear monohydric alcohol or $C_8$-$C_{13}$ saturated aliphatic branched monohydric alcohol, and specifically include n-octyl n-dodecanoate, n-nonyl n-dodecanoate, n-decyl n-dodecanoate, 2-ethylhexyl n-dodecanoate, isooctyl n-dodecanoate, isononyl n-dodecanoate, 3,5,5-trimethylhexyl n-dodecanoate, isodecyl n-dodecanoate, isoundecyl n-dodecanoate, isododecyl n-dodecanoate, isotridecyl n-dodecanoate, n-nonyl n-tetradecanoate, n-decyl n-tetradecanoate, 2-ethylhexyl n-tetradecanoate, isooctyl n-tetradecanoate, isononyl n-tetradecanoate, 3,5,5-trimethylhexyl n-tetradecanoate, isodecyl n-tetradecanoate, isoundecyl n-tetradecanoate, isododecyl n-tetradecanoate, isotridecyl n-tetradecanoate, n-nonyl n-hexadecanoate, n-decyl n-hexadecanoate, 2-ethylhexyl n-hexadecanoate, isooctyl n-hexadecanoate, isononyl n-hexadecanoate, 3,5,5-trimethylhexyl n-hexadecanoate, isodecyl n-hexadecanoate, isoundecyl n-hexadecanoate, isododecyl n-hexadecanoate, isotridecyl n-hexadecanoate, n-nonyl n-octadecanoate, n-decyl n-octadecanoate, 2-ethylhexyl n-octadecanoate, isooctyl n-octadecanoate, isononyl n-octadecanoate, 3,5,5-trimethylhexyl n-octadecanoate, isodecyl n-octadecanoate, isoundecyl n-octadecanoate, isododecyl n-octadecanoate, and isotridecyl n-octadecanoate.

Because of their ability to impart excellent fluidity and low viscosity at low temperatures to the resulting oil mixture, 2-ethylhexyl n-dodecanoate, isooctyl n dodecanoate, isononyl n-dodecanoate, 3,5,5-trimethylhexyl n-dodecanoate, isodecyl n-dodecanoate, 2-ethylhexyl n-tetradecanoate, isooctyl n-tetradecanoate, isononyl n-tetradecanoate, 3,5,5-trimethylhexyl n-tetradecanoate, isodecyl n-tetradecanoate are most preferable.

Examples of especially preferable aliphatic dibasic acid diesters are esters of adipic acid, azelaic acid or sebacic acid with a $C_8$-$C_{10}$ saturated aliphatic linear monohydric alcohol or $C_8$-$C_{13}$ saturated aliphatic branched monohydric alcohol. Specific examples include di(n-octyl)adipate, di(n-nonyl)adipate, di(n-decyl)adipate, di(2-ethylhexyl)adipate, diisooctyl adipate, diisononyl adipate, di(3,5,5-trimethylhexyl)adipate, diisodecyl adipate, diisoundecyl adipate, diisododecyl adipate, diisotridecyl adipate, di(n-octyl)azelate, di(n-nonyl)azelate, di(n-decyl)azelate, di(2-ethylhexyl)azelate, diisooctyl azelate, diisononyl azelate, di(3,5,5-trimethylhexyl)azelate, diisodecyl azelate, diisoundecyl azelate, diisododecyl azelate, diisotridecyl azelate, di(n-octyl)sebacate, di(n-nonyl)sebacate, di(n-decyl)sebacate, di(2-ethylhexyl)sebacate, diisooctyl sebacate, diisononyl sebacate, di(3,5,5-trimethylhexyl)sebacate, diisodecyl sebacate, diisoundecyl sebacate, diisododecyl sebacate, and diisotridecyl sebacate.

Among these, because of their ability to impart excellent low temperature fluidity to the resulting oil mixture, di(2-ethylhexyl)adipate, diisononyl adipate, di(3,5,5-trimethylhexyl)adipate, diisodecyl adipate, diisotridecyl adipate, di(2-ethylhexyl)azelate, diisononyl azelate, di(3,5,5-trimethylhexyl)azelate, diisodecyl azelate, diisotridecyl azelate, di(2-ethylhexyl)sebacate, diisononyl sebacate, di(3,5,5-trimethylhexyl)sebacate, diisodecyl sebacate, and diisotridecyl sebacate are most preferable.

Especially preferable polyolesters include esters of neopentyl glycol, trimethylolpropane, pentaerythritol or dipentaerythritol with a $C_4$-$C_{10}$ linear and/or branched fatty acids. Specifically, preferable are esters of one or more polyhydric alcohols selected from the group consisting of neopentyl glycol, trimethylolpropane, pentaerythritol and dipentaerythritol with one or more aliphatic monocarboxylic acids selected from the group consisting of n-butanoic acid, n-pentanoic acid, n-hexanoic acid, n-heptanoic acid, n-octanoic acid, n-nonanoic acid, n-decanoic acid, isobutanoic acid, isopentanoic acid, isohexanoic acid, isoheptanoic acid, isooctanoic acid, 2-ethylhexanoic acid, isononanoic acid, 3,5,5-trimethylhexanoic acid, and isodecanoic acid.

Among these, because of their ability to impart excellent low temperature fluidity and low kinematic viscosity at low temperatures to the resulting oil mixture, diesters of neopentyl glycol and a $C_4$-$C_{10}$ linear fatty acid are most preferable.

When at least one additional base oil selected from the group consisting of fatty acid monoesters, aliphatic dibasic acid esters and polyol esters is used in the lubricating oil for bearings of the present invention, the concentration of such additional base oil is 10-60 wt %, and preferably 20-40 wt %, of the total amount of diester (s) represented by General Formula (1) and the additional base oil.

Other Additives

To improve the performance of the lubricating oil for bearings of the present invention, it is possible to suitably add one or more additives, such as antioxidants other than the above-described phenol-based and amine-based antioxidants, metal detergents, ashless dispersants, oiliness agents, antiwear agents, extreme pressure agents, metal deactivators, rust-inhibitors, viscosity index improvers, pour point depressants, antifoaming agents, etc. The amounts of such additives are not limited, provided that the intended effects of the invention are achieved, and specific examples are as described below.

Examples of usable antioxidants, other than phenol-based and amine-based antioxidants, include di(n-dodecyl)thiodipropionate, di(n-octadecyl)thiodipropionate and like thiodipropionates, phenothiazine and like sulfur-based compounds, etc. When such antioxidants are used, the amount thereof is usually 0.01 to 5 parts by weight, and preferably 0.05 to 3 parts by weight, based on 100 parts by weight of the lubricating oil for bearings (i.e., component (a)+component (b)).

Examples of metal detergents are Ca-petroleum sulfonates, over based Ca-petroleum sulfonates, Ca-alkylbenzene sulfonates, over based Ca-alkylbenzene sulfonates, Ba-alkylbenzene sulfonates, over based Ba-alkylbenzene sulfonates, Mg-alkylbenzene sulfonates, over based Mg-alkylbenzene sulfonates, Na-alkylbenzene sulfonates, over based Na-alkylbenzene sulfonates, Ca-alkylnaphthalene sulfonates, over based Ca-alkylnaphthalene sulfonates and like metal sulfonates; Ca-phenate, over based Ca-phenate, Ba-phenate, over based Ba-phenate and like metal phenates; Ca-salicylate, over based Ca-salicylate and like metal salicylates; Ca-phosphonate, over based Ca-phosphonate, Ba-phosphonate, over based Ba-phosphonate and like metal phosphonates; over based Ca-carboxylates, etc. When such metal cleaning agents are used, the amount thereof is usually 1-10 parts by weight and preferably 2-7 parts by weight per 100 parts by weight of the lubricating oil for bearings (i.e., component (a)+component (b)).

Examples of oiliness agents include dimer acids, hydrogenated dimer acids and like polymerized fatty acids; ricinoleic acid, 12-hydroxystearic acid and like hydroxyfatty acids; lauryl alcohol, oleyl alcohol or like saturated or unsaturated aliphatic monoalcohols; stearyl amine, oleyl amine and like aliphatic saturated and unsaturated monoamines, lauramide, oleamide and like saturated or unsaturated aliphatic monocarboxylic acid amides; etc. When such oiliness agents are used, the amount is usually 0.01 parts by weight to 5 parts by weight, and preferably 0.1 parts by weight to 3 parts by weight, per 100 parts by weight of the lubricating oil for bearings (i.e., component (a)+component (b)).

Examples of usable antiwear agents and extreme pressure agents include phosphorus-based compounds. e.g., amine salts of an acid phosphate such as dibutyl phosphate, dioctyl phosphate or dicresyl phosphate, amine salts of an acid phosphite such as dibutyl phosphite or diisopropyl phosphite; sulfur-based compounds, e.g., sulfurized oils and fats, sulfurized oleic acid and like sulfurized fatty acids, di-benzyl disulfide, sulfurized olefins or dialkyl disulfides; organometallic compounds such as Zn-dialkyldithio phosphates, Zn-dialkyldithio phosphates, Mo-dialkyldithio phosphates, Mo-dialkyldithio carbamates, etc. When such antiwear agents are used, the amount is usually 0.01-10 parts by weight, and preferably 0.1-5 parts by weight, per 100 parts by weight of the lubricating oil for bearings (i.e., component (a)+component (b)).

Thiadiazole-based compounds and the like are usable as metal deactivators. When such compound(s) are used, the amount to be added is usually 0.01-0.4 parts by weight, and preferably 0.01-0.2 parts by weight, per 100 parts by weight of the lubricating oil for bearings (i.e., component (a)+component (b)).

Examples of rust-inhibitors include dodecenylsuccinic acid half esters, octadecenylsuccinic anhydrides, dodecenylsuccinic acid amide and like alkyl or alkenyl succinic acid derivatives; sorbitan monooleate, glycerol monooleate, pentaerythritol monooleate and like partial esters of polyhydric alcohols; Ca-petroleum sulfonate, Ca-alkylbenzene sulfonates, Ba-alkylbenzene sulfonates, Mg-alkylbenzene sulfonates, Na-alkylbenzene sulfonates, Zn-alkylbenzene sulfonates, Ca-alkylnaphthalene sulfonates and like metal sulfonates; and rosin amine, N-oleyl sarcosine and like amines. When such rust-inhibitors are used, the amount is usually 0.01-5 parts by weight, and preferably 0.05-2 parts by weight, per 100 parts by weight of the lubricating oil for bearings (i.e., component (a)+component (b)).

Examples of viscosity index improvers include polyalkylmethacrylates, polyalkylstyrenes, polybutenes, ethylene-propylene copolymers, styrene-diene copolymers, styrene-maleic anhydride ester copolymers, and like olefin copolymers. When such viscosity index improvers are used, the amount is usually 0.1-15 parts by weight, and preferably 0.5-7 parts by weight, per 100 parts by weight of the lubricating oil for bearings (i.e., component (a)+component (b)).

Examples of pour point depressants include condensates of chlorinated paraffin and alkylnaphthalene, condensates of chlorinated paraffin and phenol, and polyalkylmethacrylate, polyalkylstyrene, polybutene, etc., which are also viscosity index improvers as mentioned above. When such pour point depressants are used, the amount is usually 0.01-5 parts by weight, and preferably 0.1-3 parts by weight, per 100 parts by weight of the lubricating oil for bearings (i.e., component (a)+component (b)).

Liquid silicones are suitable as an antifoaming agent and the amount thereof is preferably 0.0005-0.01 parts by weight per 100 parts by weight of the lubricating oil for bearings (i.e., component (a)+component (b)).

Compared with known lubricating oils, the lubricating oil for bearings of the present invention has comparable or better heat resistance and lower kinematic viscosity, and is excellent in low temperature fluidity.

The lubricating oil for bearings of the present invention can be used for various bearings and is especially suitable for oil impregnated sintered bearings and fluid dynamic bearings. The lubricating oil for bearings of the present invention can also be used for bearings made of various kinds of materials, such as iron-based bearings, copper-based bearings or lead-based bearings, and is applicable, for example, to capstan bearings of portable radio-cassette players/recorders, portable CD players, portable MD players, etc., and motor bearings for use in cooling fan motors of automobile radiators, etc.

The lubricating oil for bearings of the present invention preferably has a kinematic viscosity at 40° C. of 5-32 $mm^2/s$, and more preferably 5-22 $mm^2/s$. From the view point of electrical power savings, it is preferable that the lubricating oil for bearings have a kinematic viscosity at 40° C. of 5-10 $mm^2/s$ and a kinematic viscosity at 0° C. of 15-40 $mm^2/s$, particularly 15-35 $mm^2/s$. These kinematic viscosity values are those measured by the method described in the Examples below.

EXAMPLES

The present invention will be described below in detail with reference to Examples and Comparative Examples; however, the present invention is not limited to these examples. The properties of the lubricating oils prepared in each example were measured and evaluated by the following methods.

Total Acid Number

Measured according to JIS-K-2501.

Kinematic Viscosity

Kinematic viscosities at 0° C., 40° C. and 100° C. were measured according to JIS-K-2283.

Viscosity Index

Measured according to JIS-K-2283.

Test for Low Temperature Fluidity

Pour points were measured according to JIS-K-2269.

Test for Heat Resistance

In a 50 ml beaker having an inside diameter of 53 mm and a height of 56 mm was placed 2 g of a bearing lubricating oil of one of the Examples and Comparative Examples. Each beaker was covered by a 200 ml beaker and heated at 150° C. in an oven for 7 days. The evaporation amount of the lubricating oil after heating was determined according to the following formula. The smaller the evaporation amount, the better the heat resistance.

$$\text{evaporation amount (\%)}=[(W_0-W)/W_0]\times 100$$

wherein $W_0$ represents the weight before the test and W represents the weight after the test.

Lubricating Ability Test-1

The coefficient of friction at 25° C. was measured using a SODA pendulum style tester. The smaller the coefficient of friction is, the better the lubricating ability is.

Lubricating Ability Test-2

Wear scar diameter under a load of 20 kg were measured using a Shell four-ball tester. The smaller the wear scar diameter, the better the lubricating ability.

Metal Compatibility Test

In a 50 ml beaker having an inside diameter of 53 mm and a height of 56 mm were placed about 30 g of a bearing lubricating oil of one of the Examples and Comparative Examples, and then metal pieces (iron, copper, and lead). Each beaker was covered by a 200 ml beaker and heated at 150° C. in an oven for 7days. After the test, the lubricating oil was filtered, and the total acid number of the lubricating oil was measured. The smaller the increase in total acid number, the more compatible with metal. The test samples used were as follows:

Iron: A piece of wire (having a length of 40 mm and a diameter of 1.6 mm) was used after abrading its surface with abrasive paper (600 grade).

Copper: A piece of wire (having a length of 40 mm and a diameter of 1.6 mm) was used after abrading its surface with abrasive paper (600 grade).

Lead: A lead block (about 1 g, manufactured by Nacalai Tesque, Inc.)

Production Example 1

In a 1-liter 4-necked flask equipped with a stirrer, a thermometer, and a water separator having a condenser tube were placed 445.0 g (3.09 mol) of n-octanoic acid (manufactured by New Japan Chemical Co., Ltd., product name: Caprylic Acid), 177 g (1.5 mol) of 3-methyl-1,5-pentanediol (manufactured by Kuraray Co., Ltd., product name: MPD), xylene (5 wt % based on the total amount of the acid and the alcohol) and tin oxide (0.2 wt % based on the total amount of the acid and the alcohol) as a catalyst, and the mixture was heated to 220° C. under reduced pressure. While removing the generated water using the water separator, an esterification reaction was conducted for about 4 hours until the amount of water collected reached the theoretical amount of generated water (54 g).

After completion of the reaction, excess acid was removed by distillation. Thereafter, the reaction mixture was neutralized with an excess of an aqueous caustic soda solution relative to the total acid number after the reaction, and washed with water until the washings became neutral. The reaction mixture was then treated with activated carbon and filtered, giving 505 g of 3-methyl-1,5-pentanediol di(n-octanoate).

The total acid number of the thus obtained ester was 0.01 (mg KOH/g), and an FT-IR analysis showed that absorption due to carboxyl groups had disappeared and ester absorption was observed, and therefore it was confirmed that the resulting ester was a diester.

Production Example 2

The procedure of Production Example 1 was repeated with the exception of using 401.7 g (3.09 mol) of n-heptanoic acid (manufactured by Wako Pure Chemical Industries, Ltd., reagent, "n-heptanoic acid") instead of n-octanoic acid, giving 496 g of 3-methyl-1,5-pentanediol di(n-heptanoate).

The total acid number of the thus obtained ester was 0.01 (mg KOH/g), and an FT-IR analysis showed that absorption due to carboxyl groups had disappeared and ester absorption was observed, and therefore it was confirmed that the resulting ester was a diester.

Production Example 3

Following the procedure of Production Example 1 and using 80.3 g (0.618 mol) of n-heptanoic acid and 356.0g (2.472 mol) of n-octanoic acid [n-heptanoic acid:n-octanoic acid=20:80 (molar ratio)] instead of n-octanoic acid, 3-methyl-1,5-pentanediol was reacted with n-heptanoic acid and n-octanoic acid, giving 503 g of an ester mixture.

The obtained ester was an ester mixture comprising a mixed diester, i.e., 3-methyl-1,5-pentanediol(n-heptanoate)(n-octanoate), 3-methyl-1,5-pentanediol di(n-heptanoate), and 3-methyl-1,5-pentanediol di(n-octanoate).

The total acid number of the thus obtained ester was 0.01 (mg KOH/g), and an FT-IR analysis showed that absorption due to carboxyl groups had disappeared and ester absorption was observed, and therefore it was confirmed that the resulting ester was a diester.

Production Example 4

Following the procedure of Production Example 1 and using 200.9 g (1.545 mol) of n-heptanoic acid and 222.5 g (1.545 mol) of n-octanoic acid [n-heptanoic acid:n-octanoic acid=50:50 (molar ratio)] instead of n-octanoic acid, 3-methyl-1,5-pentanediol was reacted with n-heptanoic acid and n-octanoic acid, giving 500 g of an ester mixture.

The total acid number of the thus obtained ester was 0.01 (mg KOH/g), and an FT-IR analysis showed that absorption due to carboxyl groups had disappeared and ester absorption was observed, and therefore it was confirmed that the resulting ester was a diester.

Production Example 5

Following the procedure of Production Example 1 and using 200.9 g (1.545 mol) of n-heptanoic acid and 244.1 g (1.545 mol) of n-nonanoic acid (manufactured by Wako Pure Chemical Industries, Ltd., reagent, "pelargonic acid") [n-heptanoic acid:n-nonanoic acid=50:50 (molar ratio)] instead of n-octanoic acid, 3-methyl-1,5-pentanediol was reacted with n-heptanoic acid and n-nonanoic acid, giving 508 g of an ester mixture.

The total acid number of the thus obtained ester was 0.01 (mg KOH/g), and an FT-IR analysis showed that absorption due to carboxyl groups had disappeared and ester absorption was observed, and therefore it was confirmed that the resulting ester was a diester.

Production Example 6

Following the procedure of Production Example 1 and using 189.1 g (1.854 mol) of n-pentanoic acid (manufactured by Nacalai Tesque, Inc., reagent "n-valeric acid") and 160.7 g (1.236 mol) of n-heptanoic acid [n-pentanoic acid:n-heptanoic acid=60:40 (molar ratio)] instead of n-octanoic acid, 3-methyl-1,5-pentanediol was reacted with n-pentanoic acid and n-heptanoic acid, giving 471 g of an ester mixture.

The total acid number of the thus obtained ester was 0.01 (mg KOH/g), and an FT-IR analysis showed that absorption due to carboxyl groups had disappeared and ester absorption was observed, and therefore it was confirmed that the resulting ester was a diester.

Production Example 7

Following the procedure of Production Example 1 and using 488.2 g (3.09 mol) of n-nonanoic acid (manufactured by Wako Pure Chemical Industries, Ltd., reagent, "pelargonic acid") instead of n-octanoic acid, 555 g of 3-methyl-1,5-pentanediol di(n-nonanoate) was obtained. The total acid number of the thus obtained ester was 0.01 (mg KOH/g), and an FT-IR analysis showed that absorption due to carboxyl groups had disappeared and ester absorption was observed, and therefore it was confirmed that the resulting ester was a diester.

Production Example 8

Following the procedure of Production Example 1 and using 222.5 g (1.545 mol) of n-octanoic acid and 244.1 g (1.545 mol) of n-nonanoic acid (n-octanoic acid:n-nonanoic acid=50:50) instead of n-octanoic acid, 3-methyl-1,5-pentanediol was reacted with n-octanoic acid and n-nonanoic acid, giving 473 g of an ester mixture.

The total acid number of the thus obtained ester was 0.01 (mg KOH/g), and an FT-IR analysis showed that absorption due to carboxyl groups had disappeared and ester absorption was observed, and therefore it was confirmed that the resulting ester was a diester.

Production Example 9

Following the procedure of Production Example 1 and using 267 g (1.854 mol) of n-octanoic acid and 212.6 g (1.236 mol) of n-decanoic acid (n-octanoic acid:n-decanoic acid=60:40) instead of n-octanoic acid, 3-methyl-1,5-pentanediol was reacted with n-octanoic acid and n-decanoic acid, giving 538 g of an ester mixture.

The total acid number of the thus obtained ester was 0.01 (mg KOH/g), and an FT-IR analysis showed that absorption due to carboxyl groups had disappeared and ester absorption was observed, and therefore it was confirmed that the resulting ester was a diester.

Examples 1-25

Using esters obtained in Production Examples 1-9, lubricating oils for bearings of Examples 1-25 were prepared having the proportions (parts by weight) of constituents as shown in Tables 1-3. The kinematic viscosity, viscosity index, total acid number, low temperature fluidity, heat resistance, lubricating ability, and metal compatibility of each bearing lubricating oil were measured. Tables 1-3 show the results. The additives used and the abbreviations thereof are listed below.

Phenol-based Antioxidant (1)

A: 4,4'-methylenebis-2,6-di-t-butylphenol (reagent, product of Tokyo Kasei Kogyo Co., Ltd.)

B: 2,6-di-t-butyl-p-cresol (reagent, product of Tokyo Kasei Kogyo Co., Ltd.)

Amine-based Antioxidant (2)

C: p,p'-dioctyldiphenylamine (product of Vanderbilt Company, product name "VANLUBE 81")

D: di(nonylphenyl)amine (product of Vanderbilt Company, product name "VANLUBE DND")

E: an alkylated diphenylamine (product of Vanderbilt Company, product name "VANLUBE NA"; di(2,4-dialkylphenyl)amine)

F: N-phenyl-1-naphthylamine (reagent, product of Wako Pure Chemical Industries, Ltd.)

Aliphatic Linear Saturated Monocarboxylic Acid (3)

G: n-tetradecanoic acid (product of New Japan Chemical Co., Ltd., product name "Myristic acid")

H: n-hexadecanoic acid (product of New Japan Chemical Co., Ltd., product name "Palmitic acid P")

I: n-octadecanoic acid (product of New Japan Chemical Co., Ltd., product name "Yukijirushi stearic acid 2000")

Phosphorus-based Compound (4)

J: tricresyl phosphate (product of New Japan Chemical Co., Ltd., product name "Sanso Cizer TCP")

K: triphenyl phosphate (reagent, product of Wako Pure Chemical Industries, Ltd.)

L: trioctyl phosphate (reagent, product of Wako Pure Chemical Industries, Ltd.)

Benzotriazole-based Compounds (5)

M: benzotriazole (product of Johoku Chemical Co. Ltd., product name "BT-120")

Gallic Acid-based Compound (6)

N: propyl gallate (reagent, product of Wako Pure Chemical Industries, Ltd.)

O: lauryl gallate (reagent, product of Wako Pure Chemical Industries, Ltd.)

Comparative Examples 1-2

The kinematic viscosity, viscosity index, total acid number, low temperature fluidity, heat resistance, lubricating ability, and metal compatibility of each ester prepared in Production Examples 1 and 3 were measured. Table 3 shows the results.

TABLE 1

| | | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 |
|---|---|---|---|---|---|---|---|---|---|---|---|---|---|
| Base oil ester | Production Example 1 | 99.50 | 99.00 | 96.95 | 96.89 | | | | | | | | |
| | Production Example 2 | | | | | 96.89 | 95.91 | 96.90 | 98.89 | | | | |
| | Production Example 3 | | | | | | | | | 99.50 | 99.45 | 99.00 | 96.95 |
| | Production Example 4 | | | | | | | | | | | | |
| | Production Example 5 | | | | | | | | | | | | |
| | Production Example 6 | | | | | | | | | | | | |
| (1) | A | 0.50 | 0.50 | 0.50 | 0.50 | 0.50 | 0.50 | 0.50 | 0.50 | 0.50 | | 0.50 | 0.50 |
| | B | | | | | | | | | | 0.50 | | |
| (2) | C | | | | | 0.50 | | | | | | 0.50 | 0.50 |
| | D | | 0.50 | 0.50 | 0.50 | | | 0.50 | 0.50 | | | | |
| | E | | | | | | 0.50 | | | | | | |
| | F | | | | | | | | | | | | |
| (3) | G | | | | | | | | | | | | |
| | H | | | 0.051 | 0.051 | 0.051 | | 0.02 | 0.05 | | 0.05 | | 0.051 |
| | I | | | | | | 0.031 | 0.02 | | | | | |
| (4) | J | | | 2.04 | 2.04 | 2.04 | 2.06 | | | | | | 2.04 |
| | K | | | | | | | 2.04 | | | | | |
| | L | | | | | | 1.03 | | | | | | |
| (5) | M | | | | 0.051 | 0.051 | 0.051 | 0.051 | 0.05 | | | | |
| (6) | N | | | | | | | 0.01 | | | | | |
| | O | | | | 0.01 | 0.01 | 0.01 | | 0.01 | | | | |
| Properties and performance | Kinematic Viscosities ($mm^2/s$) 0° C. | 28.8 | 29.0 | 31.0 | 30.7 | 23.1 | 23.3 | 23.1 | 22.7 | 27.3 | 27.3 | 28.0 | 29.1 |
| | 40° C. | 7.33 | 7.40 | 7.61 | 7.61 | 6.22 | 6.23 | 6.23 | 6.12 | 7.08 | 7.08 | 7.16 | 7.31 |
| | 100° C. | 2.41 | 2.42 | 2.43 | 2.44 | 2.12 | 2.12 | 2.13 | 2.10 | 2.34 | 2.34 | 2.35 | 2.37 |
| | Viscosity index | 165 | 166 | 156 | 160 | 161 | 160 | 164 | 163 | 166 | 168 | 163 | 159 |
| | Total acid number (mgKOH/g) | 0.01 | 0.01 | 0.12 | 0.38 | 0.39 | 0.33 | 0.39 | 0.35 | 0.01 | 0.12 | 0.01 | 0.11 |
| | Pour point (° C.) | −45 | −45 | −40 | −40 | −57.5 | −57.5 | −57.5 | −57.5 | −50 | −47.5 | −50 | −47.5 |
| | Heat resistance test (Evaporation amount %) | 6.1 | 5.8 | 5.3 | 5.3 | 11.1 | 11.5 | 11.8 | 11.1 | 5.9 | 32.8 | 6.1 | 6.1 |
| | Coefficient of friction | 0.20 | 0.19 | 0.12 | 0.12 | 0.12 | 0.10 | 0.10 | 0.12 | 0.20 | 0.13 | 0.20 | 0.12 |
| | Wear scar diameter (mm) | 0.42 | 0.42 | 0.35 | 0.35 | 0.39 | 0.39 | 0.42 | 0.47 | 0.44 | 0.44 | 0.44 | 0.36 |
| | Metal compatibility test | 1.16 | 0.85 | 0.18 | −0.12 | −0.09 | −0.11 | −0.13 | −0.12 | 1.29 | 3.85 | 0.81 | 0.12 |

TABLE 2

| | | Ex. 13 | Ex. 14 | Ex. 15 | Ex. 16 | Ex. 17 | Ex. 18 | Ex. 19 | Ex. 20 | Ex. 21 | Ex. 22 | Ex. 23 |
|---|---|---|---|---|---|---|---|---|---|---|---|---|
| Base oil ester | Production Example 1 | | | | | | | | | | | |
| | Production Example 2 | | | | | | | | | | | |
| | Production Example 3 | 96.90 | 96.94 | 96.89 | 98.89 | 96.90 | 96.89 | | | | | |
| | Production Example 4 | | | | | | | 96.89 | | | | |
| | Production Example 5 | | | | | | | | 97.39 | | | |
| | Production Example 6 | | | | | | | | | 97.42 | | |
| | Production Example 7 | | | | | | | | | | 96.73 | |

TABLE 2-continued

| | | | Ex. 13 | Ex. 14 | Ex. 15 | Ex. 16 | Ex. 17 | Ex. 18 | Ex. 19 | Ex. 20 | Ex. 21 | Ex. 22 | Ex. 23 |
|---|---|---|---|---|---|---|---|---|---|---|---|---|---|
| | Production Example 8 | | | | | | | | | | | | 96.89 |
| (1) | A | | 0.50 | 0.50 | 0.50 | 0.50 | 0.50 | 0.50 | 0.50 | 0.50 | | 0.70 | 0.50 |
| | B | | | | | | | | | | | | |
| (2) | C | | 0.50 | 0.50 | 0.50 | 0.50 | 0.50 | | 0.50 | 1.0 | 0.50 | | 0.50 |
| | D | | | | | | | | | | | 0.50 | |
| | E | | | | | | | 0.25 | | | | | |
| | F | | | | | | | 0.25 | | | | | |
| (3) | G | | | | | | | | 0.02 | | | 0.031 | 0.02 |
| | H | | 0.051 | 0.051 | 0.051 | 0.05 | 0.02 | 0.051 | 0.031 | 0.051 | | | 0.031 |
| | I | | | | | | 0.02 | | | | 0.02 | | |
| (4) | J | | 2.04 | 2.04 | 2.04 | | | | | 1.01 | 2.04 | 2.04 | 1.02 |
| | K | | | | | | 2.04 | | 1.02 | | | | |
| | L | | | | | | | 2.04 | 1.02 | | | | 1.02 |
| (5) | M | | 0.051 | | 0.051 | 0.05 | 0.051 | 0.051 | 0.051 | 0.051 | 0.051 | 0.031 | 0.051 |
| (6) | N | | | | | | | 0.01 | | 0.01 | 0.01 | | 0.01 |
| | O | | | 0.01 | 0.01 | 0.01 | 0.01 | | 0.01 | | | 0.01 | |
| Properties and performance | Kinematic Viscosities ($mm^2/s$) | 0° C. | 29.0 | 29.0 | 29.1 | 27.8 | 29.1 | 29.0 | 26.9 | 30.7 | 17.3 | 37.0 | 33.4 |
| | | 40° C. | 7.30 | 7.30 | 7.36 | 7.18 | 7.31 | 7.32 | 6.93 | 7.61 | 4.99 | 9.04 | 8.31 |
| | | 100° C. | 2.37 | 2.37 | 2.37 | 2.37 | 2.37 | 2.38 | 2.29 | 2.44 | 1.80 | 2.79 | 2.61 |
| | Viscosity index | | 158 | 158 | 155 | 167 | 159 | 159 | 161 | 159 | — | 169 | 163 |
| | Total acid number (mg KOH/g) | | 0.33 | 0.15 | 0.38 | 0.39 | 0.34 | 0.42 | 0.36 | 0.40 | 0.40 | 0.30 | 0.38 |
| | Pour point (° C.) | | −50 | −47.5 | −47.5 | −50 | −45 | −47.5 | <−60 | −52.5 | <−60 | −35 | −47.5 |
| | Heat resistance test (Evaporation amount %) | | 5.9 | 5.3 | 5.8 | 5.4 | 5.6 | 6.3 | 8.4 | 4.8 | 34.8 | 2.7 | 4.2 |
| | Coefficient of friction | | 0.13 | 0.12 | 0.11 | 0.11 | 0.11 | 0.12 | 0.13 | 0.12 | 0.13 | 0.13 | 0.12 |
| | Wear scar diameter (mm) | | 0.36 | 0.36 | 0.35 | 0.43 | 0.37 | 0.37 | 0.38 | 0.36 | 0.46 | 0.35 | 0.34 |
| | Metal compatibility test | | −0.22 | 0.25 | −0.16 | −0.10 | −0.15 | −0.09 | −0.13 | 0.06 | −0.08 | −0.10 | −0.02 |

TABLE 3

| | | | Ex. 24 | Ex. 25 | Comp. Ex. 1 | Comp. Ex. 2 |
|---|---|---|---|---|---|---|
| Base oil esters | Production Example 1 | | 96.39 | | 100.00 | |
| | Production Example 2 | | | | | |
| | Production Example 3 | | | | | 100.00 |
| | Production Example 4 | | | | | |
| | Production Example 5 | | | | | |
| | Production Example 6 | | | | | |
| | Production Example 1 | | | | | |
| | Production Example 8 | | | | | |
| | Production Example 9 | | | 96.89 | | |
| (1) | A | | 1.00 | 0.50 | | |
| | B | | | | | |
| (2) | C | | 0.50 | 0.50 | | |
| | D | | | | | |
| | E | | | | | |
| | F | | | | | |
| (3) | G | | | | | |
| | H | | 0.051 | 0.051 | | |
| | I | | | | | |
| (4) | J | | 2.04 | 1.02 | | |
| | K | | | 1.02 | | |
| | L | | | | | |
| (5) | M | | 0.051 | 0.051 | | |
| (6) | N | | | | | |
| | O | | 0.01 | 0.01 | | |
| Properties and performance | Kinematic viscosities ($mm^2/s$) | 0° C. | 31.2 | 35.3 | 28.2 | 27.0 |
| | | 40° C. | 7.69 | 8.31 | 7.31 | 7.05 |
| | | 100° C. | 2.46 | 2.73 | 2.41 | 2.34 |
| | Viscosity index | | 160 | 170 | 171 | 168 |
| | Total acid number (mg KOH/g) | | 0.35 | 0.32 | 0.01 | 0.01 |
| | Pour point (° C.) | | −40 | −40 | −45 | −52.5 |
| | Heat resistance test (Evaporation amount %) | | 4.1 | 3.5 | 58.2 | 60.6 |
| | Coefficient of friction | | 0.11 | 0.11 | 0.22 | 0.22 |
| | Wear scar diameter (mm) | | 0.34 | 0.32 | 0.45 | 0.46 |
| | Metal compatibility test | | −0.03 | −0.11 | 64.72 | 58.37 |

As is clear from Tables 1-3, the lubricating oils for bearings of Examples 1, 2, 9 and 11, comprising components (a) and (b) of the present invention, have low viscosities at 0° C. and 40° C. and high viscosity indexes, and therefore they exhibit low-viscosity properties over a wide temperature range. They also have low pour points and excellent low temperature fluidities, and are excellent in heat resistance, lubricating ability and metal compatibility.

Furthermore, the lubricating oil for bearings of the present invention obtained by combining various additives, especially, at least one member selected from the group consisting of (c) phosphorus-based compounds and aliphatic linear saturated monocarboxylic acids, and, if necessary, at least one member selected from the group consisting of (d) benzotriazole-based compounds and gallic acid-based compounds, has further improved heat resistance, lubricating ability, metal compatibility, etc., in addition to the above-mentioned properties.

In contrast, the lubricating oil comprising only the present ester without component (b), i.e., without at least one member selected from the group consisting of phenol-based antioxidants and amine-based antioxidants, as in Comparative Examples 1 and 2 shown in Table 3, are inferior in heat resistance and metal compatibility.

INDUSTRIAL APPLICABILITY

The lubricating oil for bearings of the present invention has an excellent heat resistance and a low viscosity over a wide temperature range, and therefore it can greatly save energy and fuel. Furthermore, in addition to the above-mentioned properties, the lubricating oil for bearings obtained by combining various additives also exhibits excellent lubricating ability, low temperature fluidity, and metal compatibility.

The invention claimed is:

1. A lubricating oil for bearings comprising (a) a diester represented by General Formula (1)

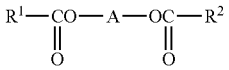

(1)

wherein $R^1$ and $R^2$ are the same or different, and each represents a $C_6$-$C_9$ linear alkyl group; A represents a monoalkyl substituted linear alkylene group, and the total number of carbon atoms of the alkyl group and the linear alkylene group is 4 to 6; and (b) at least one member selected from the group consisting of phenol-based antioxidants and amine-based antioxidants, wherein the amount of the diester is 99.99 to 95 wt % of the total amount of component (a) and component (b), wherein the lubricating oil for bearings has a kinematic viscosity at 40° C. of 5-10 $mm^2/s$ and a kinematic viscosity at 0° C. of 15-40 $mm^2/s$.

2. A lubricating oil for bearings according to claim 1, wherein A is a 3-methyl-1,5-pentanediol residue (i.e., —$CH_2CH_2$—CH($CH_3$)—$CH_2CH_2$—).

3. A lubricating oil for bearings according to claim 1, wherein the diester represented by General Formula (1) is a diester of a member selected from the group consisting of 2-methyl-1,3-propanediol, 1,3-butanediol, 2-methyl-1,4-butanediol, 1,4-pentanediol, 2-methyl-1,5-pentanediol, 3-methyl-1,5-pentanediol and 1,5-hexanediol and a member selected from $C_7$-$C_{10}$ saturated aliphatic linear monocarboxylic acids.

4. A lubricating oil for bearings according to claim 1, wherein the diester represented by General Formula (1) is a diester obtained from 3-methyl-1,5-pentanediol, and at least one member selected from the group consisting of n-heptanoic acid, n-octanoic acid, n-nonanoic acid and n-decanoic acid.

5. A lubricating oil for bearings according to claim 1, wherein the diester represented by General Formula (1) is at least one member selected from the group consisting of 3-methyl-1,5-pentanediol di(n-octanoate) and 3-methyl-1,5-pentanediol di(n-nonanoate).

6. A lubricating oil for bearings according to claim 1, wherein the diester represented by General Formula (1) is a diester obtained from two kinds of fatty acids selected from $C_7$-$C_{10}$ saturated aliphatic linear monocarboxylic acids, and one kind of dihydric alcohol selected from the group consisting of 2-methyl-1,3-propanediol, 1,3-butanediol, 2-methyl-1,4-butanediol, 1,4-pentanediol, 2-methyl-1,5-pentanediol, 3-methyl-1,5-pentanediol and 1,5-hexanediol.

7. A lubricating oil for bearings according to claim 1, wherein the diester represented by General Formula (1) is a diester obtained from 3-methyl-1,5-pentanediol and two kinds of fatty acids selected from saturated aliphatic linear monocarboxylic acids having 7 to 10 carbon atoms.

8. A lubricating oil for bearings according to claim 1, wherein the diester represented by General Formula (1) is a diester prepared from 3-methyl-1,5-pentanediol and n-heptanoic acid and n-octanoic acid, a diester prepared from 3-methyl-1,5-pentanediol and n-heptanoic acid and n-nonanoic acid, a diester prepared from 3-methyl-1,5-pentanediol and n-heptanoic acid and n-decanoic acid, a diester prepared from 3-methyl-1,5-pentanediol and n-octanoic acid and n-nonanoic acid, a diester prepared from 3-methyl-1,5-pentanediol and n-octanoic acid and n-decanoic acid, or a diester prepared from 3-methyl-1,5-pentanediol and n-nonanoic acid and n-decanoic acid.

9. A lubricating oil for bearings according to claim 1, wherein the phenol-based antioxidant has 6 to 100 carbon atoms and contains no sulfur atoms in the molecule, and the amine-based antioxidant has 6 to 60 carbon atoms and contains no sulfur atoms in the molecule.

10. A lubricating oil for bearings according to claim 9, wherein the phenol-based antioxidant is at least one member selected from the group consisting of 2,6-di-t-butylphenol, 2,6-di-t-butyl-p-cresol, 4,4'-methylenebis(2,6-di-t-butylphenol), 4,4'-butylidenebis(3-methyl-6-t-butylphenol), 2,2'-methylenebis(4-ethyl-6-t-butylphenol), 2,2'-methylenebis(4-methyl-6-t-butylphenol), 4,4'-isopropylidenebisphenol, 2,4-dimethyl-6-t-butylphenol, tetrakis[methylene-3-(3,5-di-t-butyl-4-hydroxyphenyl)-propionate]methane, 1,1,3-tris(2-methyl-4-hydroxy-5-t-butylphenyl)butane, 1,3,5-trimethyl-2,4,6-tris(3,5-di-t-butyl-4-hydroxybenzyl)-benzene, 2,2'-dihydroxy-3,3'-di(α-methylcyclohexyl)-5,5'-dimethyldiphenylmethane, 2,2'-isobutylidenebis(4,6-dimethylphenol), 2,6-bis(2'-hydroxy-3'-t-butyl-5'-methylbenzyl)-4-methylphenol, 1,1-bis(4-hydroxyphenyl)cyclohexane, 2,5-di-t-amylhydroquinone, 2,5-di-t-butylhydroquinone, 1,4-dihydroxyanthraquinone, 3-t-butyl-4-hydroxyanisole, 2-t-butyl-4-hydroxyanisole, 2,4-dibenzoylresorcinol, 4-t-butylcatechol, 2,6-di-t-butyl-4-ethylphenol, 2-hydroxy-4-methoxybenzophenone, 2,4-dihydroxybenzophenone, 2,2'-dihydroxy-4-methoxybenzophenone, 2,4,5-trihydroxybenzophenone, α-tocopherol, bis[2-(2-hydroxy-5-methyl-3-t-butylbenzyl)-4-methyl-6-t-butyl-phenyl]terephthalate, triethylene glycol-bis[3-(3-t-butyl-5-methyl-4-hydroxyphenyl-propionate), 1,6-hexanediol-bis[3-(3,5-di-t-butyl-4-hydroxyphenyl) propionate]; and the amine-based antioxidant is at least one member selected from the group consisting of diphenylamine, mono($C_4$-$C_9$ alkyl)-substituted diphenylamines, p,p'-di ($C_4$-$C_9$ alkylphenyl)amines, and di(mono $C_4$-$C_9$ alkylphenyl)amines wherein the alkyl group on one benzene ring is different from the alkyl group on the other benzene ring, di(di-$C_4$-$C_9$ alkylphenyl)amines wherein at least one of the four alkyl groups on the two benzene rings is different from the other alkyl group(s), N-phenyl-1-naphthylamine, N-phenyl-2-naphthylamine, 4-octylphenyl-1-naphthylamine, 4-octylphenyl-2-naphthylamine, p-phenylenediamine, N-phenyl-N'-isopropyl-p-phenylenediamine, and N-phenyl-N'-(1,3-dimethylbutyl)-p-phenylenediamine.

11. A lubricating oil for bearings according to claim 9, wherein component (b) is a combination of at least one member selected from the group consisting of 2,6-di-t-butyl-p-cresol, 4,4'-methylenebis(2,6-di-t-butylphenol) and 2,6-di-t-butyl-4-ethylphenol with at least one member selected from the group consisting of p,p'-dioctyl (including linear and branched) diphenylamines, p,p'-dinonyl (including linear and branched) diphenylamines, and N-phenyl-1-naphthylamine.

12. A lubricating oil for bearings according to claim 1, which further comprises (c) at least one member selected from the group consisting of phosphorus-based compounds and aliphatic linear monocarboxylic acids.

13. A lubricating oil for bearings according to claim 12, wherein the phosphorus-based compound is at least one member selected from the group consisting of phosphoric acid triesters, phosphorous acid triesters, acid phosphates and acid phosphites, each having 12 to 70 carbon atoms and containing no sulfur atoms in the molecules, and the aliphatic linear monocarboxylic acid has 12 to 22 carbon atoms.

14. A lubricating oil for bearings according to claim 12, wherein the phosphorus-based compound is at least one member selected from the group consisting of c1) tri(linear or branched $C_4$-$C_{18}$ alkyl) phosphates, c2) tri($C_4$-$C_8$ cycloalkyl) phosphates, c3) tri(unsubstituted or substituted phenyl) phosphates (the substituted phenyl group is substituted with 1 to 3 substituents selected from the group consisting of $C_1$-$C_{10}$ alkyl, halogen atom (in particular, bromine) and hydroxy group. One or two of the three phenyl groups may be unsubstituted and the rest may be substituted.), c4) tri(linear or branched $C_4$-$C_{18}$alkyl) phosphites, c5) tri($C_4$-$C_8$ cycloalkyl) phosphites, c6) tri(unsubstituted or substituted phenyl) phosphites (the substituted phenyl group is substituted with one to three substituents selected from the group consisting of $C_1$-$C_{10}$ alkyl, halogen atom (in particular, bromine) and hydroxy group. One or two of the three phenyl groups may be unsubstituted and the rest may be substituted.), c7) di(linear or branched $C_4$-$C_{18}$ alkyl) phosphates, c8) di($C_4$-$C_8$ cycloalkyl) phosphates, c9) di(unsubstituted or substituted phenyl) phosphates (the substituted phenyl group is substituted with one to three substituents selected from the group consisting of $C_1$-$C_{10}$ alkyl, halogen atom (in particular, bromine) and hydroxy group. One of the two phenyl groups may be unsubstituted and the other may be substituted.), c10) di(linear or branched $C_4$-$C_{18}$ alkyl) phosphites, c11) di($C_4$-$C_8$ cycloalkyl) phosphites, and c12) di(unsubstituted or substituted phenyl) phosphites (the substituted phenyl group is substituted with 1 to 3 substituents selected from the group consisting of $C_1$-$C_{10}$ alkyl, halogen atom (in particular, bromine) and hydroxy group. One of the two phenyl groups may be unsubstituted and the other may be substituted.), and the aliphatic linear monocarboxylic acid has 14 to 18 carbon atoms.

15. A lubricating oil for bearings according to claim 12, wherein said at least one member selected from the group consisting of phosphorus-based compounds and aliphatic linear monocarboxylic acids is a combination of at least one member selected from the group consisting of tri(n-octyl) phosphate, triphenyl phosphate and tricresyl phosphate with at least one member selected from the group consisting of n-tetradecanoic acid, n-hexadecanoic acid and n-octadecanoic acid.

16. A lubricating oil for bearings according to claim 12, which further comprises (d) at least one member selected from the group consisting of benzotriazole-based compounds and gallic acid-based compounds.

17. A lubricating oil for bearings according to claim 16, wherein the benzotriazole-based compound has 6 to 60 carbon atoms and contains no sulfur atoms in the molecule, and the gallic acid-based compound has 7 to 30 carbon atoms.

18. A lubricating oil for bearings according to claim 16, wherein the benzotriazole-based compound is at least one member selected from the group consisting of benzotriazole, 5-methyl-1H-benzotriazole, 1-dioctylaminomethylbenzotriazole, 1-dioctylaminomethyl-5-methylbenzotriazole, 2-(5'-methyl-2'-hydroxyenyl)benzotriazole, 2-[2'-hydroxy-3',5'-bis(α, α-dimethylbenzyl)phenyl]-2H-benzotriazole, 2-(3',5'-di-t-butyl-2'-hydroxyphenyl)benzotriazole, 2-(3'-t-butyl-5'-methyl-2'-hydroxyphenyl)-5-chlorobenzotriazole, 2-(3',5'-di-t-butyl-2'-hydroxyphenyl)-5-chlorobenzotriazole, 2-(3',5'-di-t-amyl-2'-hydroxyphenyl)benzotriazole, 2-(5'-t-butyl-2'-hydroxyphenyl)benzotriazole, 2-(2'-hydroxy-5'-methylphenyl)benzotriazole, 2-(2'-hydroxy-5'-t-octylphenyl)benzotriazole, and 2-[2'-hydroxy-3'-(3",4"-5",6"tetrahydrophthalidemethyl)-5'-methylphenyl] benzotriazole; and the gallic acid-based compound is at least one member selected from the group consisting of gallic acid, linear or branched $C_1$-$C_{22}$ alkyl esters of gallic acid and $C_4$-$C_8$ cycloalkyl esters of gallic acid.

19. A lubricating oil for bearings according to claim 16, wherein the benzotriazole-based compound is selected from the group consisting of benzotriazole and 5-methyl-1H-benzotriazole, and the gallic acid-based compound is selected from the group consisting of (n-propyl) gallate, (n-octyl) gallate and (n-dodecyl) gallate.

20. A lubricating oil for bearings according to claim 1, which further comprises an additional base oil.

21. A lubricating oil for bearings according to claim 12, which further comprises an additional base oil.

22. A lubricating oil for bearings according to claim 16, which further comprises an additional base oil.

* * * * *